US007929899B2

(12) United States Patent
Fukunaga et al.

(10) Patent No.: US 7,929,899 B2
(45) Date of Patent: Apr. 19, 2011

(54) WASTE TONER CONTAINER, WASTE TONER-ACCUMULATING STRUCTURE, AND IMAGE FORMING APPARATUS EQUIPPED THEREWITH

(75) Inventors: Yasuyuki Fukunaga, Osaka (JP); Shinobu Oohata, Osaka (JP)

(73) Assignee: Kyocera Mita Corporation (JP)

( * ) Notice: Subject to any disclaimer, the term of this patent is extended or adjusted under 35 U.S.C. 154(b) by 95 days.

(21) Appl. No.: 12/429,630

(22) Filed: Apr. 24, 2009

(65) Prior Publication Data

US 2009/0269112 A1 Oct. 29, 2009

(30) Foreign Application Priority Data

Apr. 25, 2008 (JP) ..... 2008-115542

(51) Int. Cl.
*G03G 21/12* (2006.01)

(52) U.S. Cl. ..... 399/360

(58) Field of Classification Search ..... 399/358–360
See application file for complete search history.

(56) References Cited

U.S. PATENT DOCUMENTS 5,634,172 A 5/1997 Manabe

FOREIGN PATENT DOCUMENTS

JP 11-272142 10/1999

*Primary Examiner* — Hoang Ngo
(74) *Attorney, Agent, or Firm* — Gerald E. Hespos; Michael J. Porco

(57) ABSTRACT

Disclosed is a waste toner container for collecting waste toner removed from an image bearing member. The waste toner container includes a receiving section adapted to introduce the waste toner from an inlet port provided in an upper region thereof, and receive therein the waste toner dropped down through the inlet port, an accumulation section arranged to extend from the receiving section in a lateral direction approximately perpendicular to a dropping direction of the waste toner and rotatably coupled to the receiving section, and a rotary member adapted to allow for rotation of the accumulation section.

16 Claims, 23 Drawing Sheets

WASTE TONER CONTAINER, WASTE TONER-ACCUMULATING STRUCTURE, AND IMAGE FORMING APPARATUS EQUIPPED THEREWITH

BACKGROUND OF THE INVENTION

1. Field of the Invention

The present invention relates to a waste toner container for collecting waste toner removed from an image bearing member, such as a photosensitive drum or an intermediate transfer belt, a waste toner-accumulating structure, and an image forming apparatus equipped therewith.

2. Description of the Related Art

In an image forming apparatus, such as a copier or a printer, a toner image formed on a photosensitive drum is directly transferred onto a sheet, or transferred onto a sheet through an intermediate transfer belt. In this process, a part of a toner of the toner image fails to be transferred, and remains as a non-transferred toner on an image bearing member, such as the photosensitive drum or the intermediate transfer belt. If this non-transferred toner remains untreated, it will preclude performing a next cycle of image forming operation with desirable quality. Therefore, the non-transferred toner is removed by a cleaning device, such as a drum cleaner or a belt cleaner, and then collected as waste toner (see, for example, JP 11-272142A; hereinafter referred to as "D1").

In an image forming apparatus disclosed in the document D1, a non-transferred toner remaining on a photosensitive drum is removed by a cleaning device, and the removed non-transferred toner is transported by a transport screw and collected into a waste toner box (waste toner container). Then, when a full state of waste toner in the waste toner box is detected by a sensor, a user opens a pass door arranged in a lateral surface of an apparatus body. Then, the user draws out a holder to take out the waste toner container held in the holder and replace the waste toner container with a new one. In this manner, it is facilitated to achieve a longer life duration of a process cartridge.

However, in the image forming apparatus disclosed in the document D1, waste toner dropped down from an opening provided in an upper portion of the waste toner container into the container will be piled up directly below the opening. Thus, the sensor installed adjacent to the opening detects a top portion of the piled waste toner to output a signal indicative of a waste-toner full state. Consequently, even though a space capable of collecting much more waste toner actually remains in the waste toner container, a user will replace the waste toner container according to the indication of the sensor. This leads to an increase in frequency of replacement of a waste toner container, an unnecessary waste of a waste toner container itself, and an increase in user's burden of replacement operations.

SUMMARY OF THE INVENTION

It is an object of the present invention to provide a waste toner container capable of allowing for movement of waste toner therewith, and reducing the user's burden of replacement operations.

In order to achieve this object, according to one aspect of the present invention, there is provided a waste toner container for collecting waste toner removed from an image bearing member. The waste toner container comprises: a receiving section adapted to introduce the waste toner from an inlet port provided in an upper region thereof and receive therein the waste toner dropped down through the inlet port; an accumulation section arranged to extend from the receiving section in a lateral direction approximately perpendicular to a dropping direction of the waste toner and rotatably coupled to the receiving section; and a rotary member adapted to allow for rotation of the accumulation section.

DETAILED DESCRIPTION OF THE PREFERRED EMBODIMENTS

Figure 1:
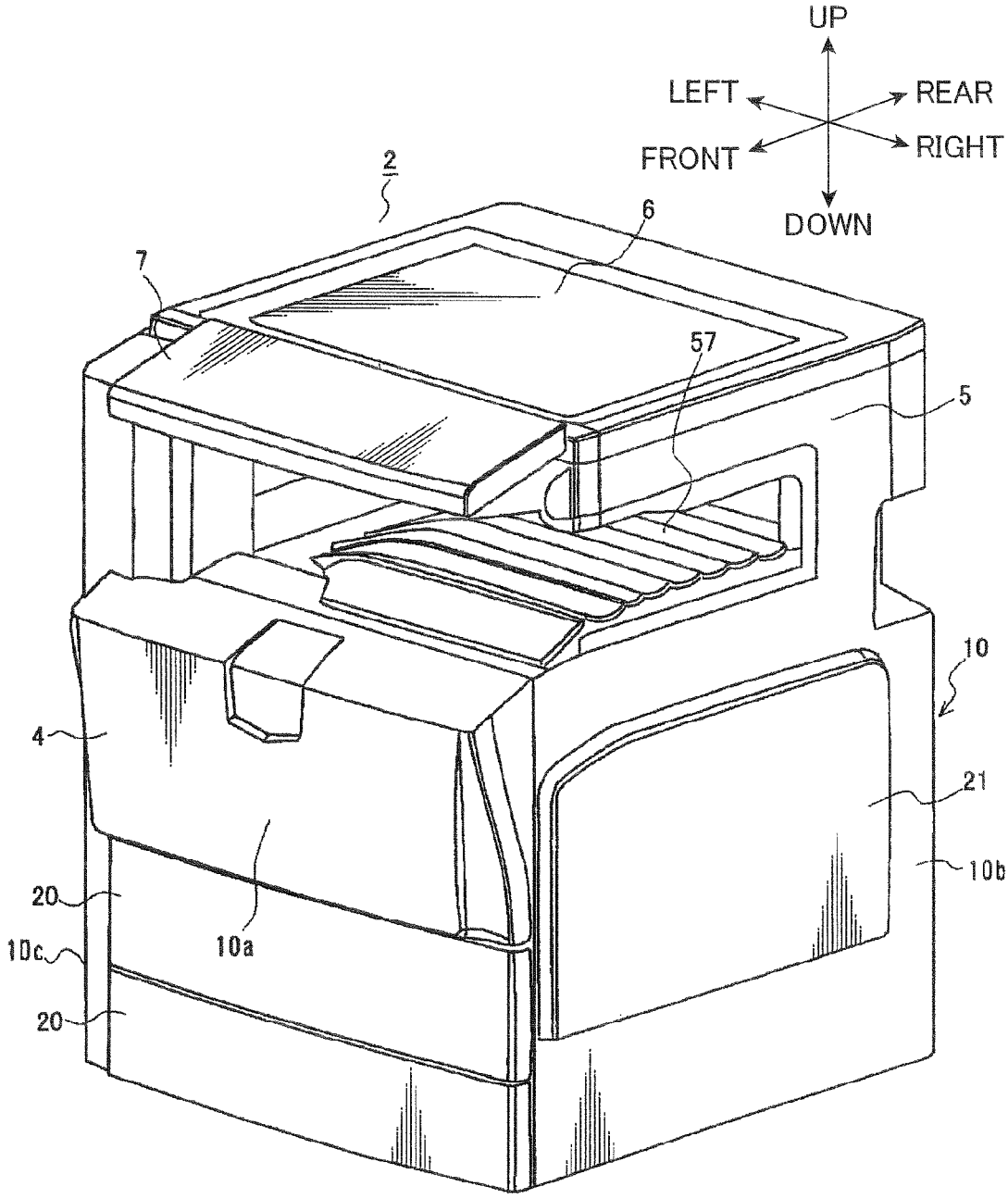
FIG. 1 is a perspective view showing an image forming apparatus according to one embodiment of the present invention.

With reference to the drawings, the present invention will now be described based on an embodiment thereof. In FIGS. 1 to 23, structurally the same elements or components are defined by a common reference numeral or code, and a duplicate description thereabout will be omitted on a case-by-case basis. Further, in FIGS. 1 to 23, an element or component unnecessary for explanation is omitted from illustration, on a case-by-case basis.

First Embodiment

A waste toner container 83, a waste toner-accumulating structure and an image forming apparatus 2 equipped therewith, according to one embodiment of the present invention, will be described below, with reference to the drawings.

[Image Forming Apparatus]

Figure 2:
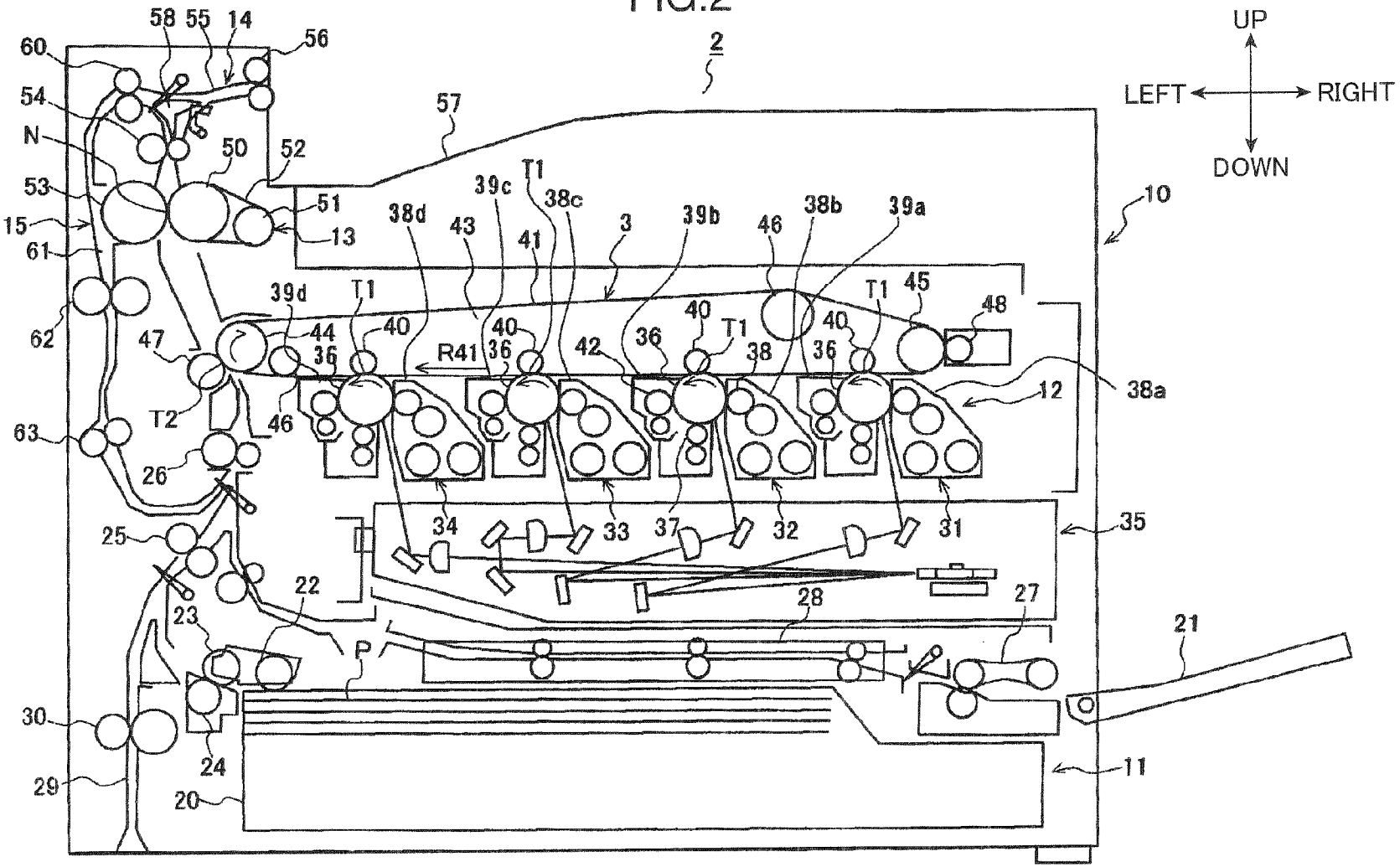
FIG. 2 is a schematic diagram showing an internal structure of the image forming apparatus.
Figure 3:
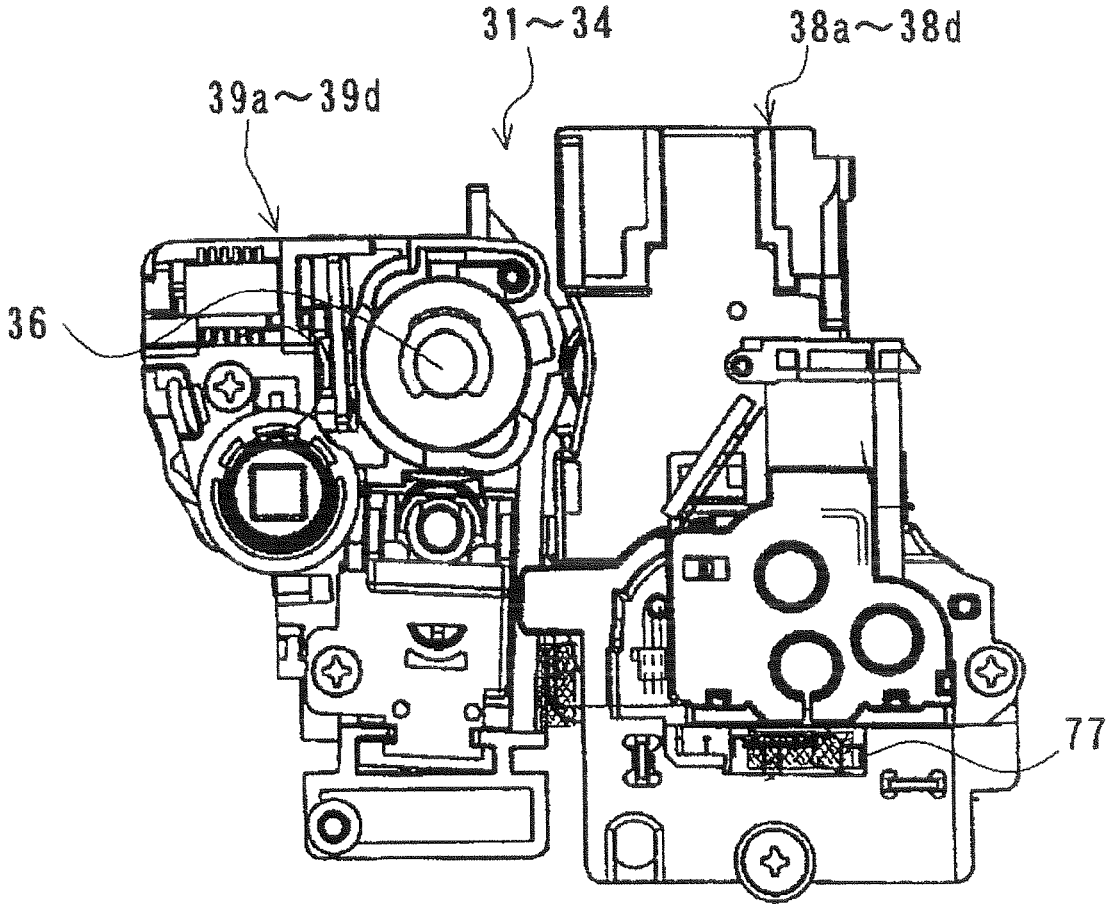
FIG. 3 is a front end view showing a drum unit and a development device.
Figure 4:
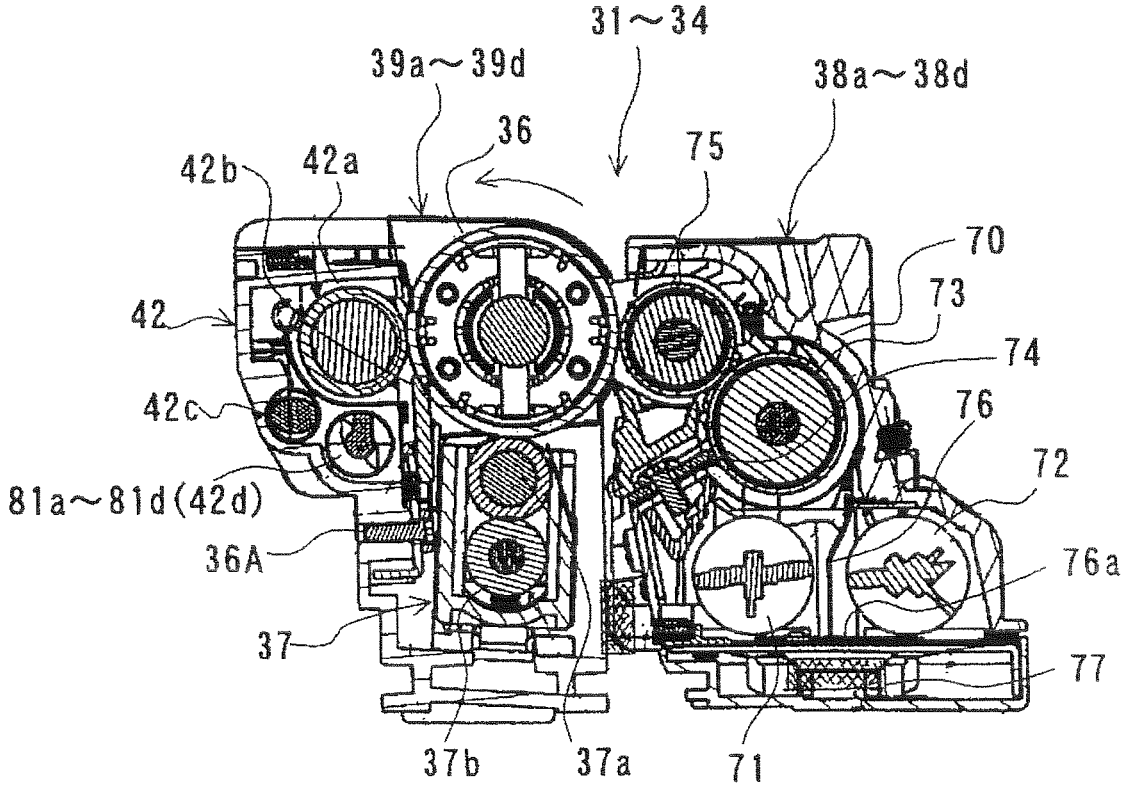
FIG. 4 is a sectional view showing the drum unit and the development device in FIG. 3, taken along a plane perpendicular to a frontward-rearward direction of an apparatus body of the image forming apparatus.
Figure 5B:
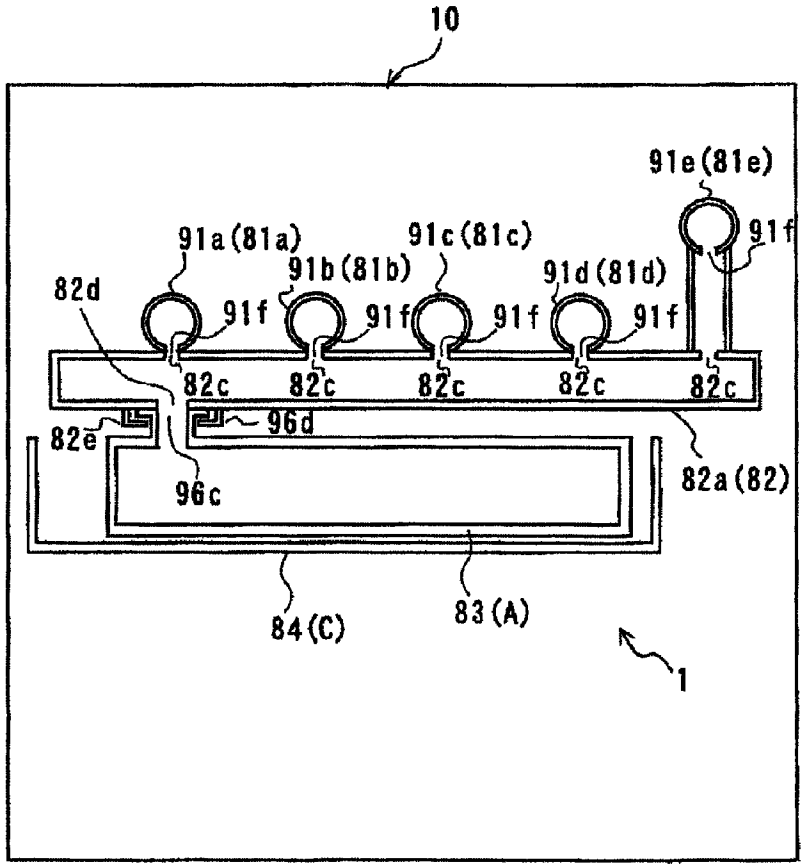
FIG. 5B is a sectional view taken along the line VB-VB in FIG. 5A.
Figure 5A:
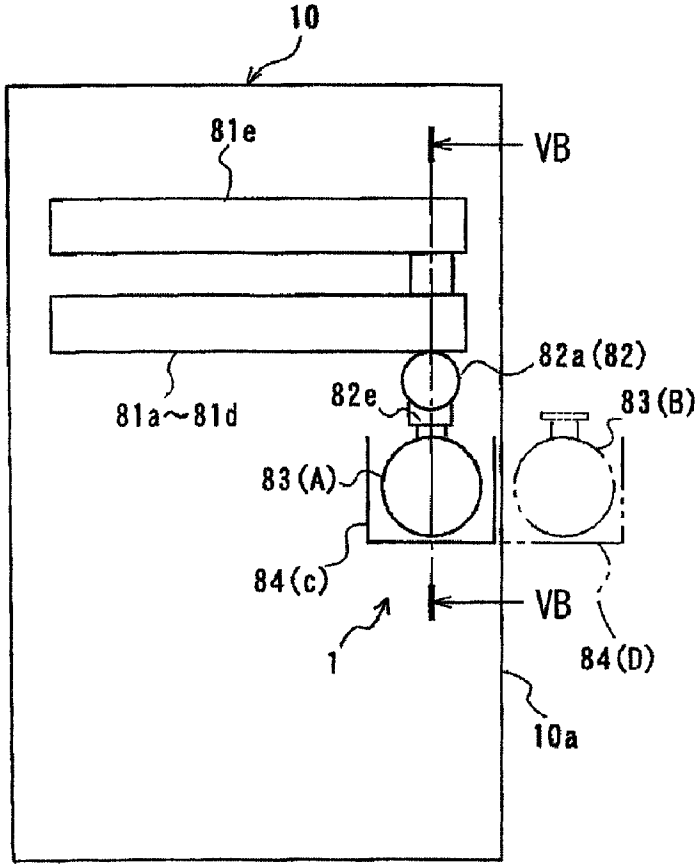
FIG. 5A is a schematic diagram generally showing a waste-toner collection system, when viewed from a left side of an apparatus body of the image forming apparatus.
Figure 6:
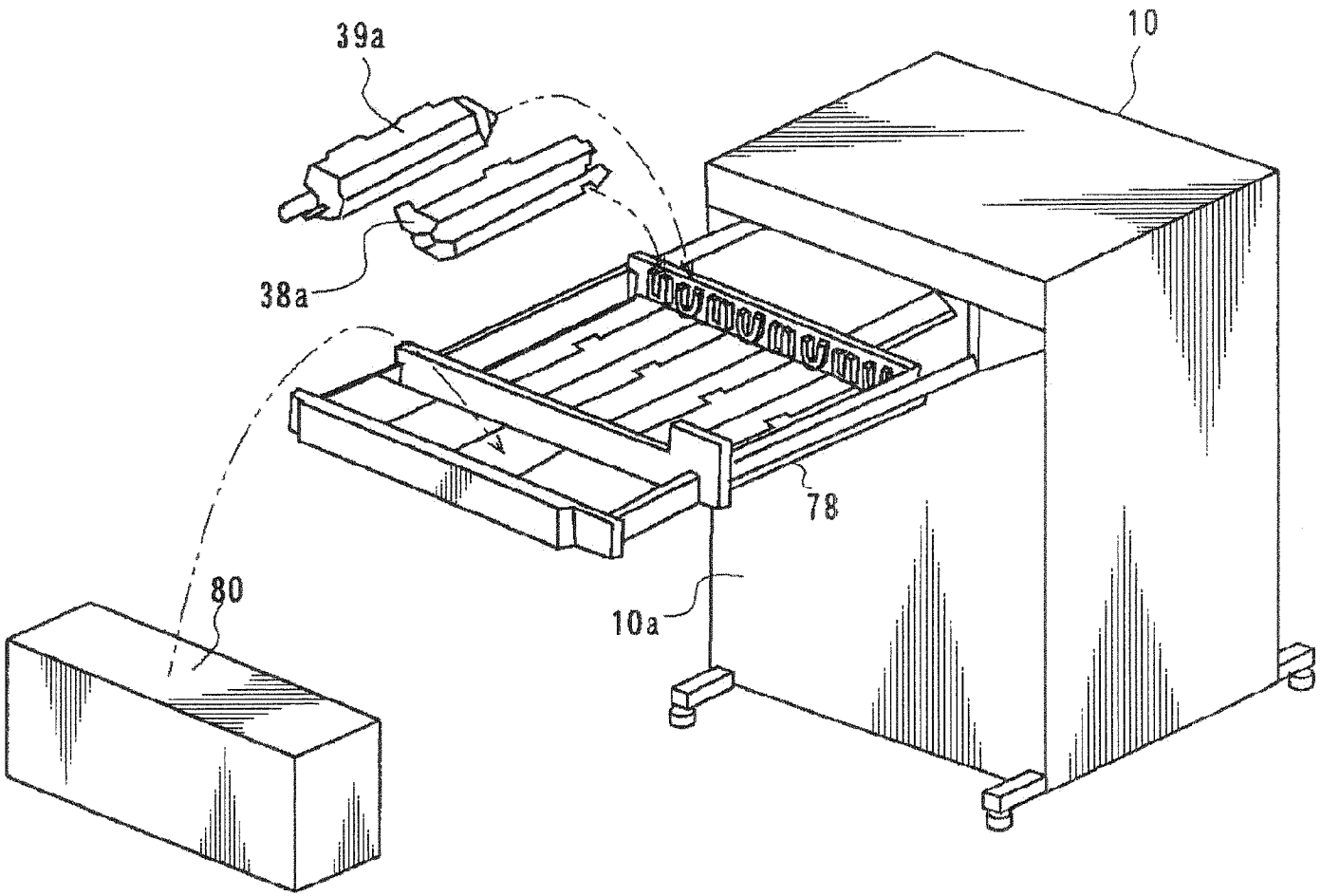
FIG. 6 is a perspective view showing a state after an image-forming-module frame is drawn out from the apparatus body, and the drum unit, the development device and a retainer unit are detached from the image-forming-module frame.

With reference to FIGS. 1 to 6, the image forming apparatus 2 will be specifically described. FIG. 1 is a perspective view showing the image forming apparatus 2, when viewed from a rightward and obliquely upward position on the side of a front surface 10*a* (on a front side) thereof (the front side means one side of the image forming apparatus 2 on which a manual operation panel 7 is provided, and a user including a service person is located when he/she is using the image forming apparatus 2). FIG. 2 is a schematic diagram showing an internal structure of the image forming apparatus 2, when viewed from the side of the front surface 10*a*, wherein an image reading section 5 illustrated in FIG. 1 is omitted from illustration. FIG. 3 is a front end view showing one of four drum units 39*a* to 39*d* and a corresponding one of four development devices 38*a* to 38*d*, when viewed from the side of the front surface 10*a*. FIG. 4 is a sectional view showing the drum unit and the development device in FIG. 3, taken along a plane perpendicular to a frontward-rearward direction of an apparatus body 10 of the image forming apparatus 2. FIG. 5A is a schematic diagram generally showing a waste-toner collection system 1, when viewed from a left side of the apparatus body 10. FIG. 5B is a sectional view taken along the line VB-VB in FIG. 5A. FIG. 6 is a perspective view showing a state after an image-forming-module frame 78 is drawn out from the apparatus body 10, and one of the drum unit 39*a*, the development device 38*a* and a retainer unit 80 are detached from the image-forming-module frame 78.

As shown in FIG. 1, the image forming apparatus 2 includes an apparatus body 10. The apparatus body 10 is provided with a sheet feed cassette 20 and a door 4 on a front surface 10*a* (first side surface) thereof, wherein the sheet feed cassette 20 is adapted to be drawn out in a frontward direction of the apparatus body 10, and the door 4 is adapted to be openable in the frontward direction. The apparatus body 10 is also provided with an openable/closable manual sheet-loading tray 21 on a right lateral surface 10*b* (third side surface) thereof, and an openable/closable cover member (not shown) on a left lateral surface 10*c* (fourth side surface) thereof, wherein the cover member is opened and closed during an operation of handling jamming of a sheet P. The apparatus body 10 is further provided with a catch tray 57 on an upper surface thereof, and an image reading section 5 at a position above and spaced apart from the catch tray 57. The image reading section 5 includes a contact glass 6 provided in an upper surface thereof to allow a user to place thereon a document (not shown) having an image to be read. Furthermore, the apparatus body 10 is provided with a manual operation panel 7 on a front side of the contact glass 6. Although not illustrated in FIG. 1, the image reading section 5 includes an openable/closable document-pressing plate adapted to cover the contact glass 6.

As shown in FIG. 2, the image forming apparatus 2 further comprises a sheet feed section 11, an image forming section 12, a fixing section 13, a sheet ejection section 14 and a sheet re-feed section 15, which are housed in the apparatus body 10.

(Sheet Feeding Section)

The sheet feed section 11 is adapted to feed a sheet from a selected one of the sheet feed cassette 20, the manual sheet-loading tray 21, and a large-capacity deck (not shown) disposed in a lower region of the apparatus body 10. In the operation of feeding a sheet from the sheet feed cassette 20, a plurality of sheets P stored in the sheet feed cassette 20 in a stacked state are fed out from the sheet feed cassette 20 and separated one-by-one by a sheet feed roller 23 and a retard roller 24, and then the separated sheet P is transported toward a registration roller pair 26 by a transport roller pair 25. In the operation of feeding a sheet from the manual sheet-loading tray 21, a sheet P set on the manual sheet-loading tray 21 is fed out from the manual sheet-loading tray 21 by a manually-loaded-sheet feed unit 27, and then transported toward the registration roller pair 26 by a manually-loaded-sheet transport unit 28. In the operation of feeding a sheet from the large-capacity deck, a sheet P fed out from the large-capacity deck is transported through a transport path 29 extending upwardly along a left end of the apparatus body 10, toward the registration roller pair 26 by a transport roller pair 30.

The sheet P fed from the sheet feed cassette 20, the manual sheet-loading tray 21 or the large-capacity deck is temporarily stopped by the registration roller pair 26 to correct a skew of the sheet P, and then transported to the image forming section 12 in synchronization with a toner image being transported by an after-mentioned intermediate transfer belt 41 in the image forming section 12.

(Image Forming Section)

The image forming section 12 is provided with four image forming stations: a magenta (M)-image forming station 31, a cyan (C)-image forming station 32, a yellow (Y)-image forming station 33 and a black (BK)-image forming station 34, an exposure device 35, and an intermediate transfer belt unit 3. Each of the image forming stations 31 to 34 has the same structure. Thus, only the cyan-image forming station 32 will be specifically described below while terming it as "image forming station 32", and a detailed description about the remaining image forming stations 31, 33, 34 will be omitted.

The image forming station 32 is provided with a photosensitive drum 36 (which is one image bearing member). The photosensitive drum 36 is adapted to allow an electrostatic latent image to be formed thereon by a charge device 37, and the exposure device 35. This electrostatic latent image is developed as a toner image by the development device 38 made up as a development unit. In regard to the development device, when it is necessary to distinguish it on a color-by-color basis (i.e., with respect to each of the image-forming stations), a magenta-image development device, a cyan-image development device, a yellow-image development device and a black-image development device will be referred to respectively, as "development device 38*a*", "development device 38*b*", "development device 38*c*" and "development device 38*d*".

The toner image formed on the photosensitive drum 36 is primarily transferred onto the after-mentioned intermediate transfer belt 41 (which is one image bearing member) of the intermediate transfer belt unit 3 by a primary transfer roller 40. A non-transferred toner remaining on a surface of the photosensitive drum 36 after completion of the toner-image transfer operation is removed therefrom by a drum cleaner 42 (which is one cleaning device). The removed non-transferred toner is collected into a waste toner container 83 disposed on the side of the front surface 10*a* of the apparatus body 10. This point will be more specifically described later.

The intermediate transfer belt unit 3 comprises a frame 43, a plurality of rollers supported by the frame 43, such as a driving roller 44, a driven roller 45, a tension roller 46 and primary transfer rollers 40, and an endless-shaped intermediate transfer belt 41 wound around and between the plurality of rollers in a tensioned manner. The intermediate transfer belt 41 is circulatingly moved in the arrowed direction R41 according to a rotation of the driving roller 44 in the arrowed direction (clockwise direction in FIG. 2).

Toner images of the four colors formed on respective ones of the photosensitive drums 36 in the image-forming stations 31 to 34 are primarily transferred onto the intermediate transfer belt 41 in sequence by the corresponding primary transfer rollers 40 at respective primary transfer positions T1, in such a manner that they are superimposed together on the intermediate transfer belt 41. The integrally-superimposed four-color toner image on the intermediate transfer belt 41 is secondarily transferred onto a sheet P fed from the sheet feed section 11 by a secondary transfer roller 47 at a secondary transfer position T2. Then, a non-transferred toner remaining on a surface of the intermediate transfer belt 41 after completion of the toner-image transfer operation is removed therefrom by a belt cleaner 48 (which is one cleaning device).

(Fixing Section)

The fixing section 13 includes a fixing roller 50, a heating roller 51, a fixing belt 52 wound around and between the fixing and heating rollers 50, 51 in a tensioned manner, and a pressing roller 53. The fixing belt 52 and the pressing roller 53 are disposed to define a fixing nip zone N therebetween. The sheet P having the toner image transferred onto a front face thereof in the image forming section 12 is heated and pressed while passing through the fixing nip zone N, so that the toner image is fixed on the front face of the sheet P.

(Sheet Ejection Section)

The sheet ejection section 14 is adapted to transport the sheet P after completion of the toner-image fixing operation, along a sheet ejection path 55 by a transport roller pair 54, and ejected onto the catch tray 57 by a sheet ejection roller pair 56.

(Sheet Re-Feed Section)

The sheet re-feed section 15 is adapted, when a double-side printing mode is selected, to turn the sheet P having the toner image fixed on the front face thereof, upside down, and then transport the sheet P to a re-transport path 61 by a re-transport roller pair 60. Specifically, the sheet P is transported to the sheet ejection path 55, and, just after a trailing edge of the sheet P passes beyond a flapper 58, the flapper 58 is positionally shifted, and the sheet ejection roller pair 56 is reversely rotated, so that the sheet P is turned upside down and transported to the re-transport path 61. Subsequently, the sheet P is transported by re-transport roller pairs 62, 63, and re-fed to the image forming section 12. Then, a toner image is transferred onto a rear face of the sheet P re-fed to the image forming section 12, and fixed on the rear face in the fixing section 13, whereafter the sheet P is ejected onto the catch tray 57 through the sheet ejection path 55.

(General Operation of Image Forming Apparatus)

The image forming apparatus 2 having the above structure is operable to transfer an integrally-superimposed four-color toner image formed in the image forming section 12, onto a front face of a sheet P fed from the sheet feed section 11, and, after fixing the toner image on the front face in the fixing section 13, eject the sheet P onto the catch tray 57 of the sheet ejection section 14. According to the need, the image forming apparatus 2 is operable to send the sheet P after completion of the toner-image transfer operation, to the sheet re-feed section 15 to transfer a toner image onto a rear face of the sheet P, and, after fixing the toner image on the rear face, eject the sheet P onto the catch tray 57.

(Image Forming Station, Development Device, Drum Unit)

As shown in FIGS. 2 and 3, each of the image forming stations 31, 32, 33, 34 includes a corresponding one of four drum units 39*a*, 39*b*, 39*c*, 39*d*, and a corresponding one of the development devices (development units) 38*a*, 38*b*, 38*c*, 38*d*.

As shown in FIG. 4, each of the drum units 39*a* to 39*d* is formed as a unit by integrally installing the photosensitive drum 36, the charge device 37, the drum cleaner 42 and other components into a drum frame 36A. The charge device 37 includes a charge roller 37*a* adapted to charge the surface of the photosensitive drum 36 to a given polarity and potential, and a cleaning roller 37*b* adapted to remove a foreign substance attached onto a surface of the charge roller 37*a*, such as toner. The drum cleaner 42 includes a combination of a cleaning roller 42*a* and a cleaning blade 42*b* adapted to remove a non-transferred toner from the surface of the photosensitive drum 36, a sweep roller 42*c* adapted to sweep the cleaning roller 42*a*, and a first transport screw 42*d* adapted to transport a toner removed from the photosensitive drum 36, to the side of the front surface 10*a* (see FIG. 1).

Each of the development devices 38*a*, 38*b*, 38*c*, 38*d* is formed by integrally installing two agitating members 71, 72, a magnet roller 73, a layer-thickness control member (chain-cutting plate) 74, a development roller 75 and other components into a developer container (reservoir) 70 for storing toner. In the development device (38*a*, 38*b*, 38*c* or 38*d*) illustrated in FIG. 4, a two-component developer consisting primarily of a nonmagnetic toner made of a synthetic resin material, and a magnetic carrier (carrier particles), is used.

The developer container 70 has an agitating chamber 76 provided in a lower region thereof to store the developer therein. The two agitating rollers 71, 72 are provided in the agitating chamber 76 to agitate the developer so as to uniformly mix the carrier particles and the toner particles together while giving frictional charges to the toner particles. The agitated developer is supplied to the magnet roller 73, and the carrier particles each having the toner particles electrostatically attached on a surface thereof are chained together on a surface of the magnet roller 73. Then, when the developer carried on the surface of the magnet roller 73 passes by a distal end of the layer-thickness control member according to a rotation of the magnet roller 73 in a clockwise direction in FIG. 4, a part of the chained carrier particles are cut off by the layer-thickness control member, so that a layer thickness of the developer is adequately controlled.

The developer having the controlled layer thickness is brought into contact with the development roller 75, and only the toner is moved to and carried by a surface of the development roller 75. Then, according to a rotation of the development roller 75 in the clockwise direction, the toner carried by the development roller 75 is transported to a development position where the development roller 75 and the photosensitive drum 36 is in closest relation to each other. At the development position, according to a development bias applied between the development roller 75 and the photosensitive drum 36, the toner is attached to an electrostatic latent image on the surface of the photosensitive drum 36, to form a toner image. The development container 70 has a duct 77 provided just below a bottom wall 76*a* of the agitating chamber 76. The duct 77 has a cross-sectionally rectangular shape elongated in a rightward-leftward (lateral) direction of the image forming apparatus 2, and extends in the frontward-rearward direction. More specifically, the duct 77 is arranged to extend in a direction from a front end to a rear end of the developer container 70 so as to serve as a developer-cooling duct.

(Image-Forming-Module Frame)

As shown in FIG. 6, the image forming apparatus 2 has an image-forming-module frame 78 adapted, in a state after the door 4 (see FIG. 1) is opened, to be selectively drawn out and retracted from/into the apparatus body 10. Specifically, under a condition that the image-forming-module frame 78 is drawn out from the apparatus body 10, the development device 38*a* and the drum unit 39*a* as replaceable modules can be attached to and detached from the image-forming-module frame 78 from thereabove. Although not illustrated in FIG. 6, the remaining development devices 38*b* to 38*d* and the remaining drum units 39*b* to 39*d* can also be attached and detached in the same manner. The image-forming-module frame 78 is formed to allow a retainer unit 80 to be detachably attached thereto at a position frontward of the development devices 38*a* to 38*d* and the drum units 39*a* to 39*d*, in such a manner that a longitudinal direction thereof is oriented in the lateral direction of the apparatus body 10.

The drum units 39*a* to 39*d* are provided, respectively, with four 81*a* to 81*d* of five first transport sections 81*a* to 81*e* constituting a waste-toner collection system 1, wherein the remaining first transport section 81*e* is provided in the belt cleaner 48 (see FIG. 2). Further, the retainer unit 80 is provided with a second transport section 82, a waste toner container 83 and a holder tray 84, which constitutes the waste-toner collection system 1. The detail of the waste-toner collection system 1 will be described in more detail below.

In the following description, the five first transport sections 81*a* to 81*e* will be described simply as "first transport section 81", when it is not necessary to discriminate between them, or they are generically described. Further, in an operation of replacing (attaching/detaching) the waste toner container 83 illustrated in FIGS. 5A, 5B, a user manually opens the door 4 of the apparatus body 10 illustrated in FIG. 1, to expose a front surface of the retainer unit 80 illustrated in FIG. 6, and draw out and retract the holder tray 84 in a frontward direction and a rearward direction of the retainer unit 80 (apparatus body 10), respectively, without drawing out the image-forming-module frame 78, as described later. Thus, in the following description, a part of the retainer unit 80 other than the holder tray 84 and the waste toner container 83 will be regarded as a part of the apparatus body 10.

[Waste-Toner Collection System]

FIGS. 5A and 5B schematically show a general configuration of the waste-toner collection system 1 in the image forming apparatus 2 according to this embodiment. As shown in FIGS. 5A to 5B, the waste-toner collection system 1 includes five first transport sections 81*a* to 81*e* arranged to extend in the frontward-rearward direction of the apparatus body 10, one second transport section 82 arranged to extend in the lateral direction of the apparatus body 10 (image forming apparatus 2) at a position on the side of the front surface 10*a* of the apparatus body 10 and below the five first transport sections 81*a* to 81*e*, a waste toner container 83 disposed below the second transport section 82 and adapted to accumulate waste toner therein, and a holder tray 84 adapted to be drawn out from and pushed into the retainer unit 80 from the side of the front surface 10*a* of the apparatus body 10, while holding the waste toner container 83.

(First Transport Section)

In FIG. 4, each of the first transport sections 81*a* to 81*d* provided in respective ones of the drum units 39*a* to 39*d* appears as a cross-section taken along a plane perpendicular to the frontward-rearward direction of the apparatus body 10. Each of the first transport sections 81*a* to 81*d* includes a first transport passage 91*a* to 91*d* (see FIGS. 10 and 11), and a first transport screw 42*d* provided inside the first transport passage 91*a* to 91*d*.

Each of the first transport passages 91*a* to 91*d* is made up of a part of a casing wall of a corresponding one the drum cleaners 42 to have a tubular shape extending in the frontward-rearward direction of the apparatus body 10. Each of the first transport screws 42*d* is adapted to be rotated in a given direction so as to transport a non-transferred toner (waste toner) removed (scraped) by the cleaning roller 42*a* and the cleaning blade 42*b* of the corresponding drum cleaners 42, in a direction from a rear surface to the front surface (i.e., the frontward direction) of the apparatus body 10 through a corresponding one of the first transport passages 91*a* to 91*d*.

The belt cleaner 48 (see FIG. 2) is also provided with transport means substantially identical to the first transport section (81*a* to 81*d*) of the drum cleaner 42. Specifically, a transport passage 91*e* and a transport screw (not shown) substantially identical, respectively, to the first transport passage (91*a* to 91*d*) and the first transport screw 42*d*, are provided in the belt cleaner 48 to transport a non-transferred toner removed from the intermediate transfer belt 41, to an after-mentioned second transport section 82 in the frontward direction of the apparatus body 10.

A first outlet port 91*f* (see FIG. 5B) is formed at a lower portion of each of the first transport passages 91*a* to 91*e* on the front side of the apparatus body 10. According to the rotation of the first transport screws 42*d*, the waste toner is transported in the frontward direction through the first transport passages 91*a* to 91*e*, and dropped down from the first outlet ports 91*f* into the after-mentioned second transport section 82.

(Retainer Unit)

Figure 7:
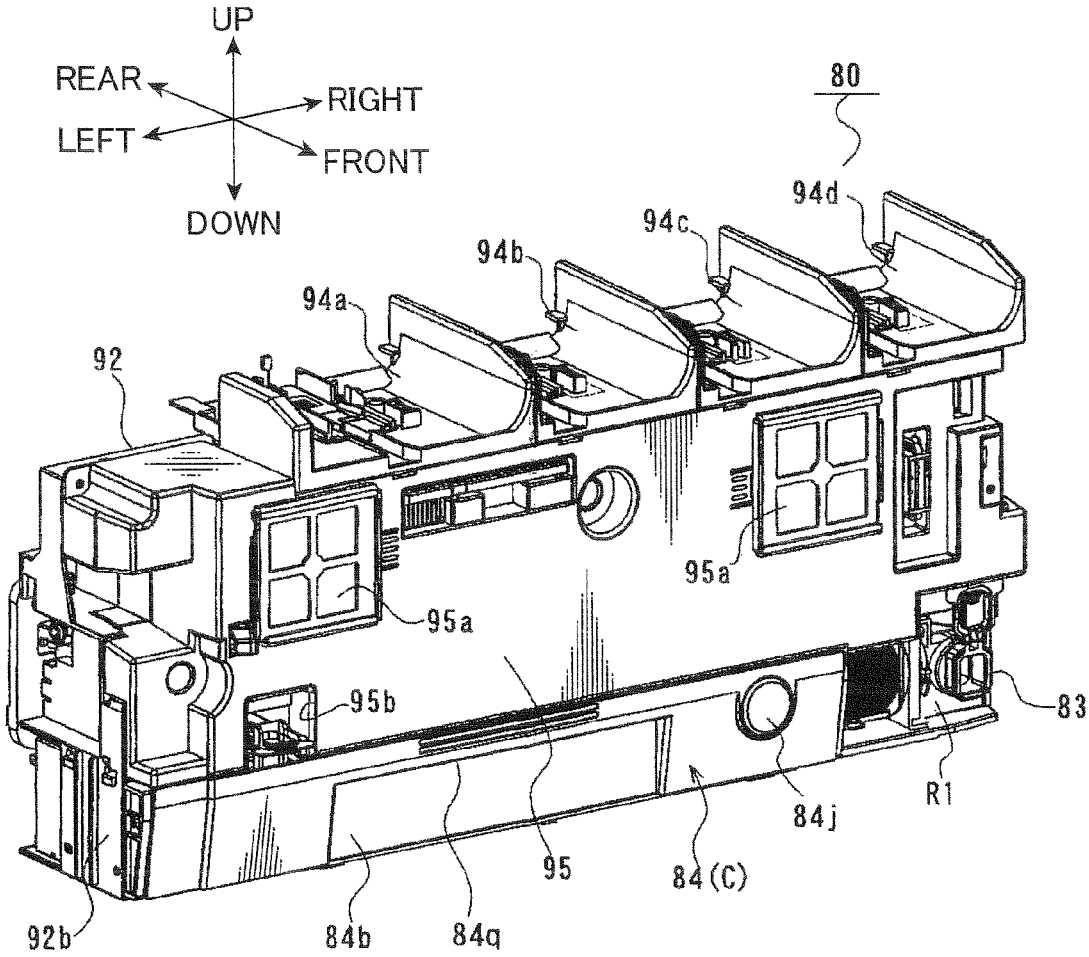
FIG. 7 is a perspective view generally showing the retainer unit in a state after a holder tray is set in a retracted position, when viewed from a leftward and obliquely upward position on a front side thereof.
Figure 8:
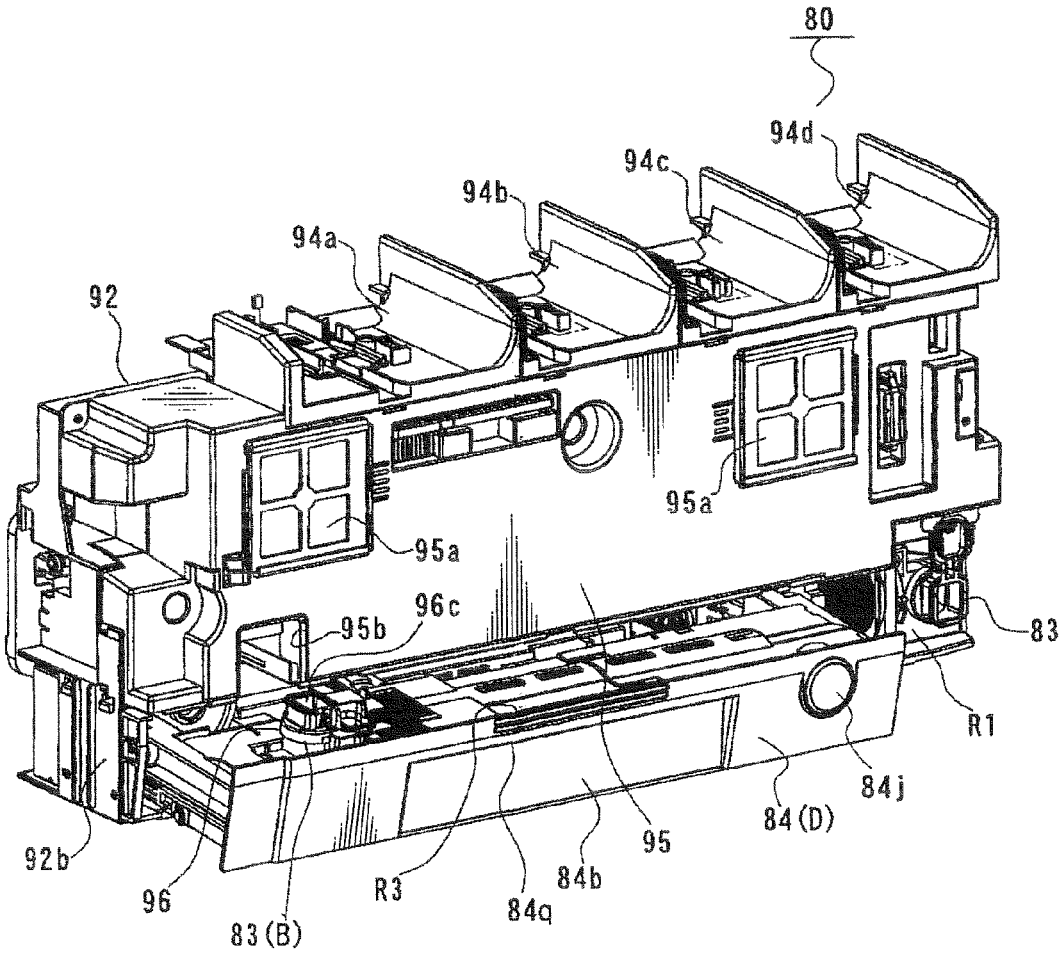
FIG. 8 is a perspective view generally showing the retainer unit in a state after the holder tray is set in a drawn-out position, when viewed from the leftward and obliquely upward position on the front side thereof.
Figure 9:
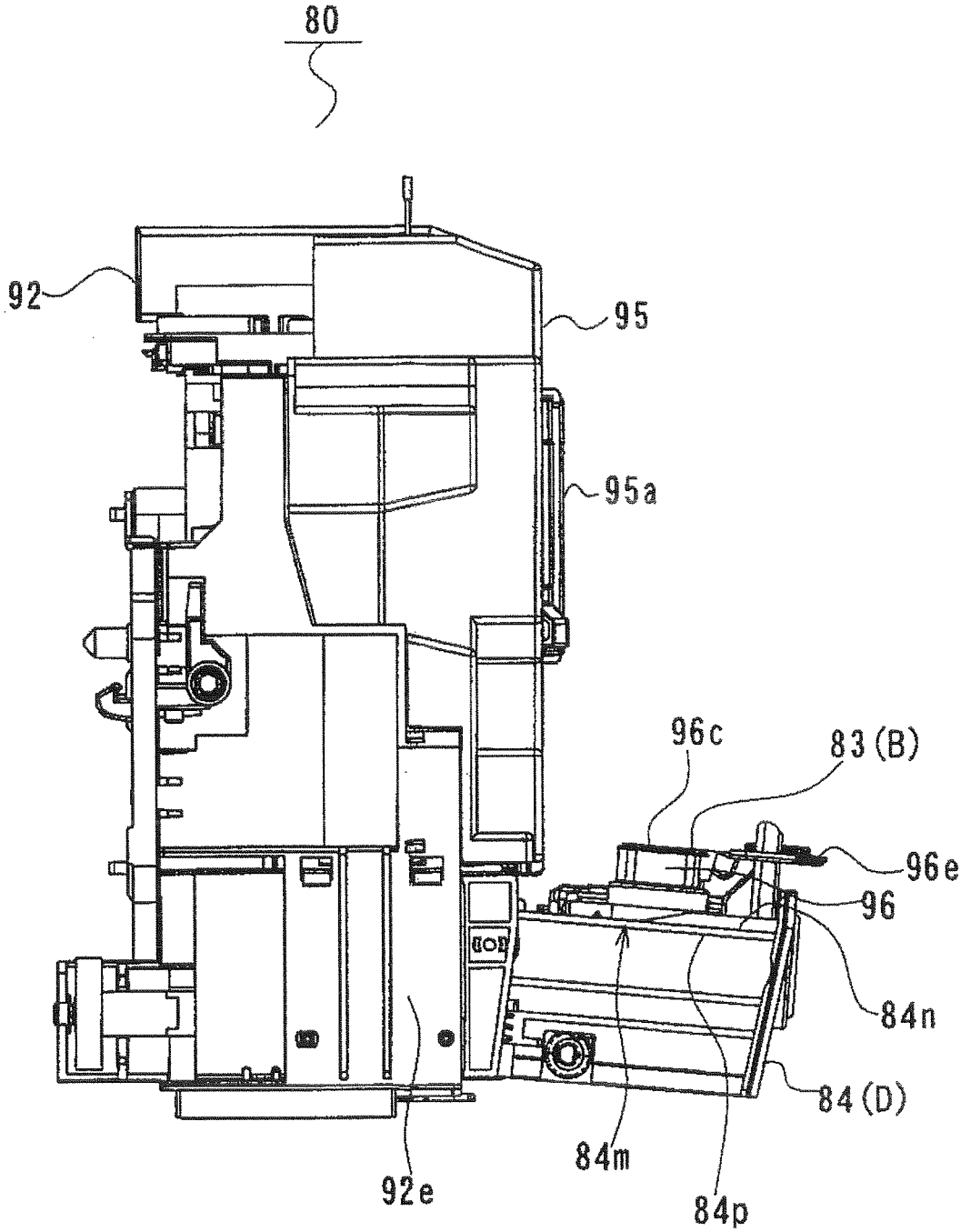
FIG. 9 is a left side view showing the retainer unit in FIG. 8.
Figure 10:
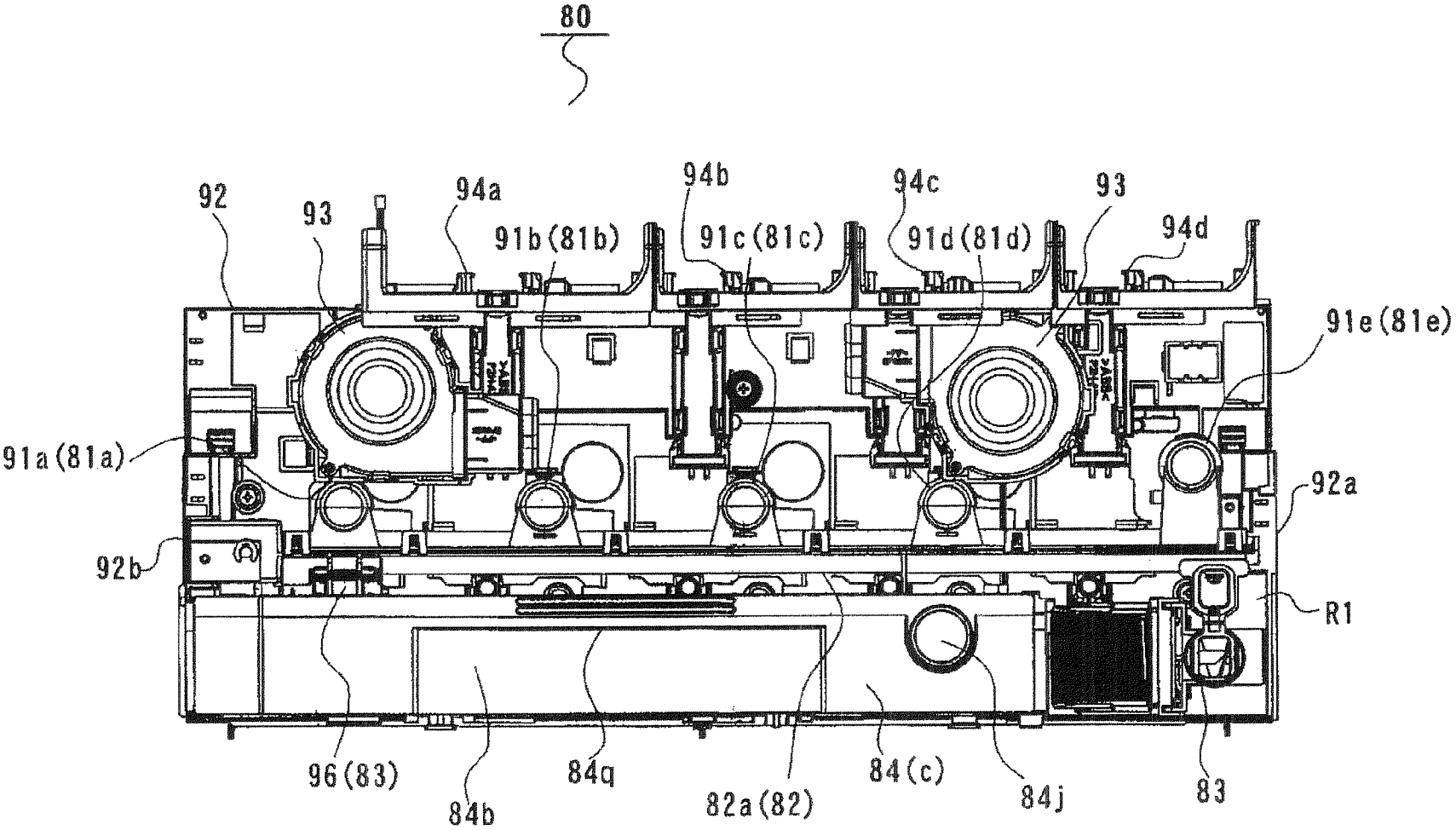
FIG. 10 is a front view showing the retainer unit in a state after a front cover is detached therefrom.
Figure 11:
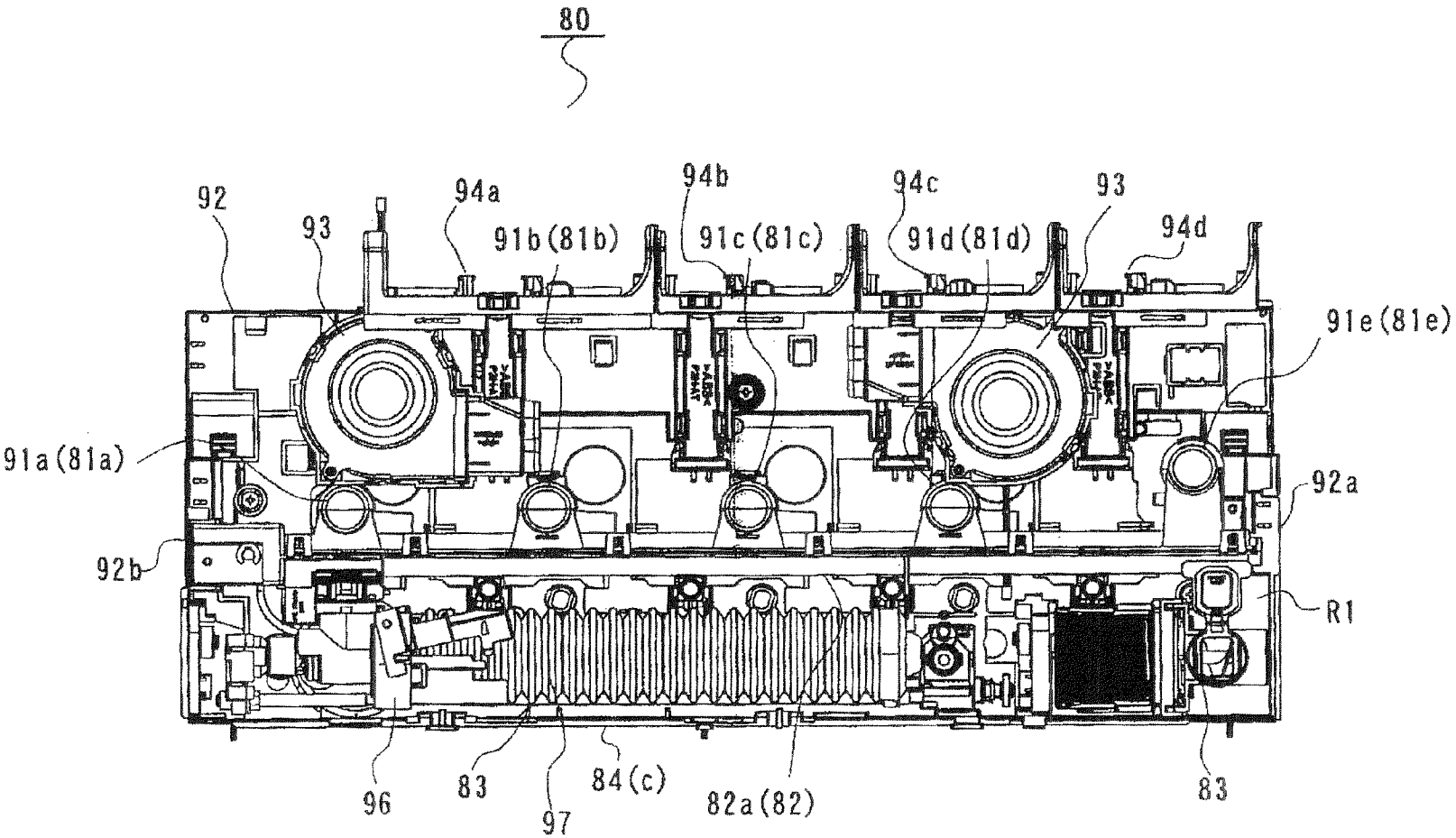
FIG. 11 is a front view showing the retainer unit in a state after a front plate of the holder tray is further removed to expose an inside of the holder tray, from the state illustrated in FIG. 10.
Figure 12:
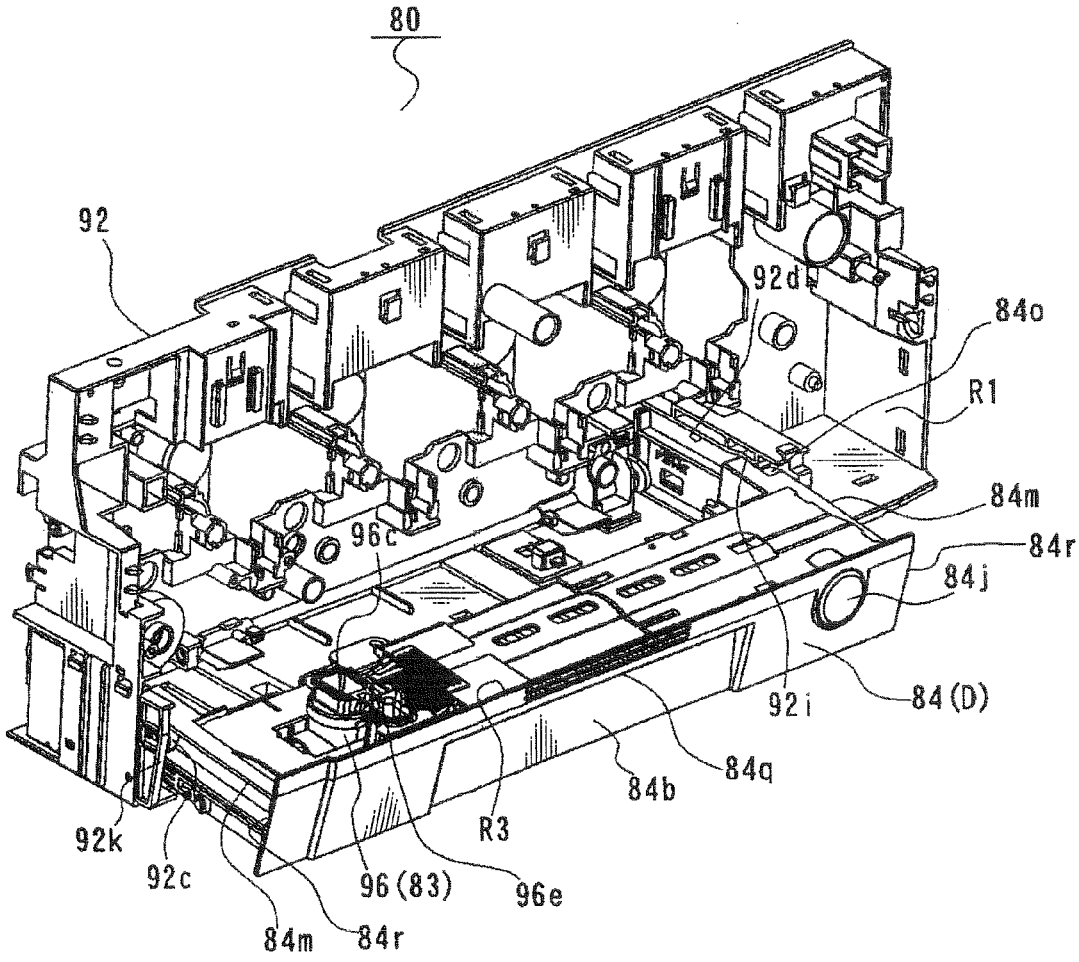
FIG. 12 is a perspective view showing the retainer unit in a state after the front cover and two cooling fans are detached therefrom, from the state illustrated in FIG. 8.
Figure 13:
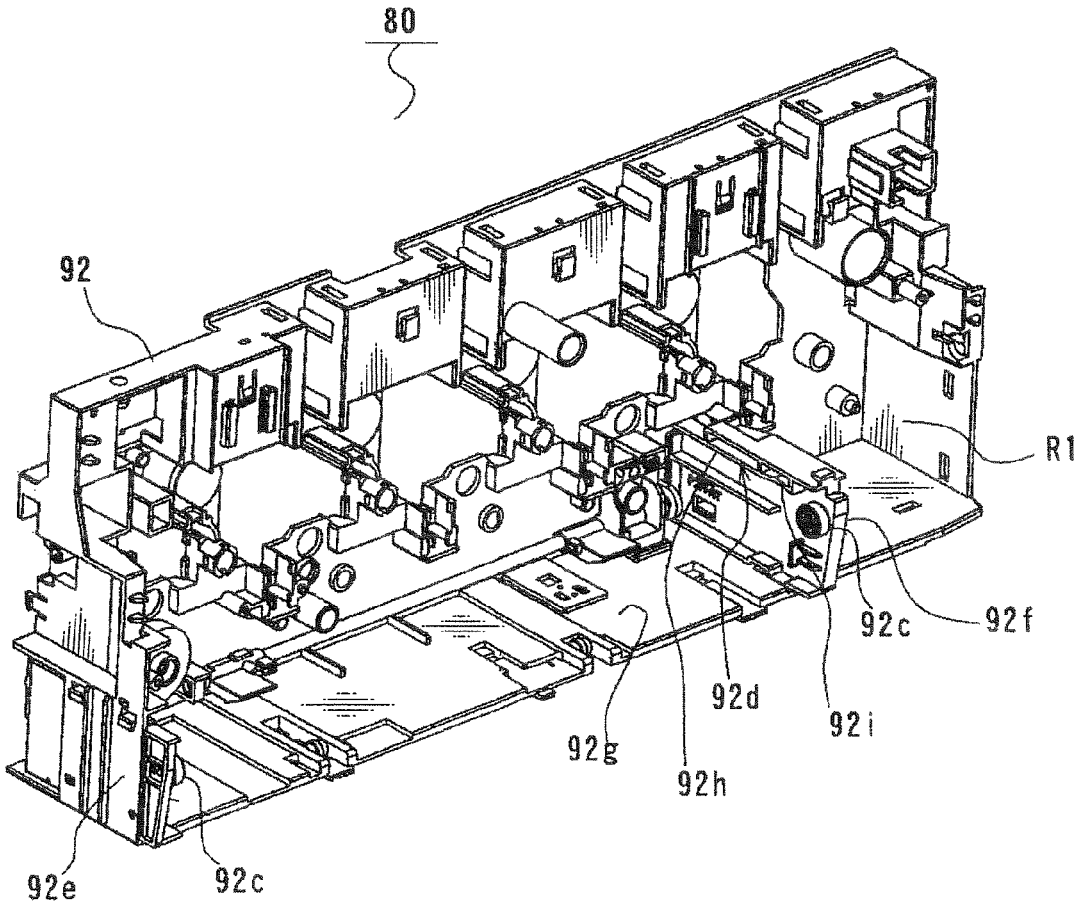
FIG. 13 is a perspective view showing the retainer unit in a state after the holder tray is drawn away therefrom, from the state illustrated in FIG. 12.

The retainer unit 80 illustrated in FIGS. 7 to 13 is provided with a second transport section 82. FIG. 7 is a perspective view generally showing the retainer unit 80 in a state after the holder tray 84 is set in a retracted position C, when viewed from a leftward and obliquely upward position on the front side thereof. FIG. 8 is a perspective view generally showing the retainer unit 80 in a state after the holder tray 84 is set in a drawn-out position D, when viewed from the leftward and obliquely upward position on the front side thereof. FIG. 9 is a left side view showing the retainer unit 80 in FIG. 8. FIG. 10 is a front view showing the retainer unit 80 in a state after a front cover 95 is detached therefrom. FIG. 11 is a front view showing the retainer unit 80 in a state after a front plate 84*b* of the holder tray 84 is further removed to expose an inside of the holder tray 84, from the state illustrated in FIG. 10. FIG. 12 is a perspective view showing the retainer unit 80 in a state after the front cover 95, two cooling fans 93 and the second transport section 82 are detached therefrom, from the state illustrated in FIG. 8. FIG. 13 is a perspective view showing the retainer unit 80 in a state after the holder tray 64 is drawn away therefrom, from the state illustrated in FIG. 12.

As shown in FIG. 7, the entire retainer unit 80 is formed in a rectangular parallelepiped shape in which a dimension in an upward-downward direction is greater than that in the frontward-rearward direction, and a dimension in the rightward-leftward (lateral) direction is greater than that in the vertical direction. The retainer unit 80 includes; a retainer body 92 (see FIG. 13); the holder tray 84 (see FIG. 12) housed in a lower region of the retainer body 92 drawably in the frontward direction of the retainer body 92; the waste toner container 83 (see FIGS. 11 and 12) held inside the holder tray 84; the second transport section 82 (see FIG. 10) arranged above the holder tray 84 set in the retracted position C to extend in the lateral direction of the apparatus body 10; the two cooling fans 93 adapted to send cooling air into the respective ducts 77 of the development devices 38*a* to 38*d* (see FIG. 4); four support members 94*a* to 94*d* each adapted to support a respective one of four toner containers (not shown) which store therein respective toners of the four colors to be replenished to corresponding ones of the development devices 38*a* to 38*d*; and a front cover 95 (see FIG. 7) which covers a front of the retainer body 92 and has two fresh-air inlets 95*a* formed at respective positions corresponding to the cooling fans 93.

As shown in FIG. 12, the retainer body 92 has a storage space R1 located on a right side of the holder tray 84 in the lower region of the retainer body 92. As shown in FIG. 10, an unused spare waste toner container 83 is stored in the storage space R1 in a compacted state after shortening an accumulation section 97 thereof. Further, as shown in FIGS. 7 and 8, the front cover 95 has a rectangular-shaped cutout 95*b* formed on a right side of a lower end thereof. In the operation of drawing out or retracting the holder tray 84 from or into the retainer body 92, the cutout 95*b* can prevent an inlet port 96*c* of the waste toner container 83 protruding upwardly from an upper end of the holder tray 84 from interfering with the front cover 95.

(Second Transport Section)

As shown in FIGS. 10 and 11, the first transport sections 81*a* to 81*d* are arranged below the cooling fans 93, and the second transport section 82 is arranged below respective portions of the first transport sections 81*a* to 81*d* on the front side of the apparatus body 11 and above the holder tray 84, to extend in the lateral direction. The second transport section 82 comprises a tubular-shaped second transport passage 82*a*, and a second transport screw 82*b* (see FIG. 23) disposed inside the second transport passage 82*a*. The second transport passage 82*a* is formed and arranged to extend from a vicinity of a right lateral surface 92*a* to a vicinity of a left lateral surface 92*b* of the retainer body 92, i.e., extend from a position just below the rightmost first transport section 81*e* corresponding to the belt cleaner 48, to a position just below the leftmost first transport section 81*a* corresponding to the photosensitive drum in the black-image forming station 34.

The second transport passage 82*a* has an upper portion formed with five waste toner-inlet ports 82*c* (see FIG. 5*a*) at positions corresponding to respective ones of the first outlet ports 91*f* of the first transport passages 91*a* to 91*e*. Each of the first outlet ports 91*f* is connected to a corresponding one of the inlet ports 82*c* by use of sealing means, such as a packing, to prevent leakage of waste toner. Waste toner within the first transport passages 91*a* to 91*e* is transported in the frontward direction of the apparatus body 10 according to the rotation of the first transport screws 42*d* in a given direction, and sent into the second transport passages 82*a* through the first outlet 91*f* and the inlet ports 82*c*.

The second transport passage 82*a* has a lower portion formed with a second outlet port 82*d* (see FIG. 5B) at a position on the side of the left lateral surface 92*b*. The second outlet port 82*d* is connected with an after-mentioned inlet port 96*c* of the waste toner container 83. The second transport section 82 further has a second positioning portion 82*e* provided below the second outlet port 82*d*. The second positioning portion 82*e* is adapted, when the waste toner container 83 is moved from a replacement position B to a collection position A in conjunction with the operation of pushing the holder tray 84 from the drawn-out position D illustrated in FIGS. 8 and 9 to the retracted position C illustrated in FIG. 7, to guide a sliding movement of a flange 96*d* provided in the waste toner container 83 at a position adjacent to the inlet port 96*c*, and position the inlet port 96*c* through the flange 96*d*. Specifically, the inlet port 96*c* is positioned in the rearward direction of the apparatus body 10 by allowing respective back surfaces (rear surfaces) of right and left protruding portions 84*r* of a front plate 84*b* illustrated in FIG. 12 to be brought into contact with two stoppers 92*k* provided on the retainer body 92 at positions corresponding to the back surfaces.

(Holder Tray)

The holder tray 84 is adapted to be movable in the lower region on the side of the front surface of the retainer body 92, between the retracted position C (see FIG. 7) where the holder tray 84 has been pushed into the retainer body 92 approximately horizontally from the side of the front surface 10*a* of the apparatus body 10 (i.e., in the rearward direction), and the drawn-out position D (see FIGS. 8 and 9) where the holder tray 84 has been drawn out from the retainer body 92 approximately horizontally from the side of the front surface 10*a* (i.e., in the frontward direction). FIGS. 14 to 17 show the holder tray 84 in a state after being drawn out from the retainer body 92.

Figure 14:
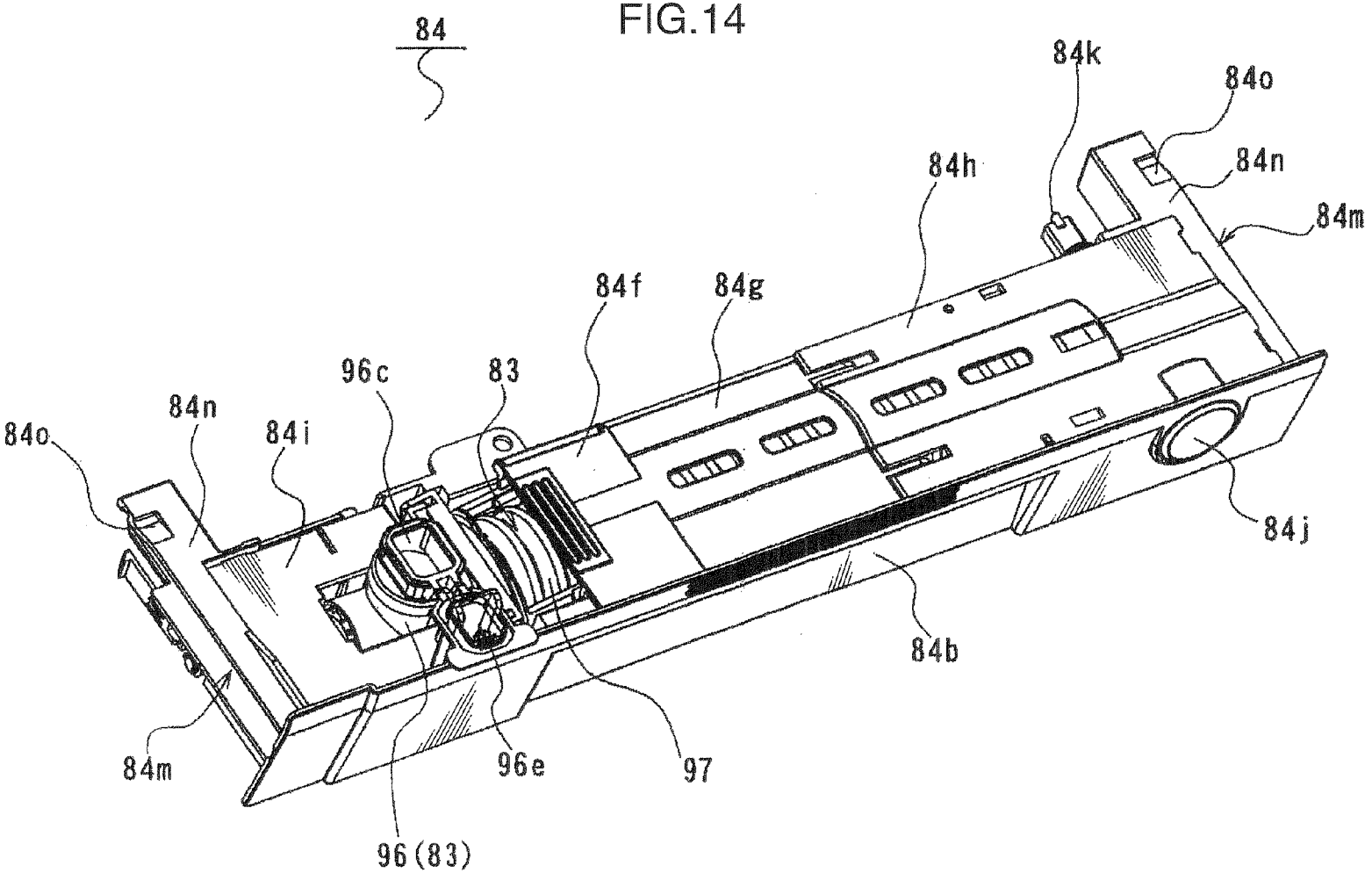
FIG. 14 is a perspective view showing the holder tray which holds a waste toner container and has an upper cover attached thereto, when viewed from a leftward and obliquely upward position on a front side thereof.
Figure 15:
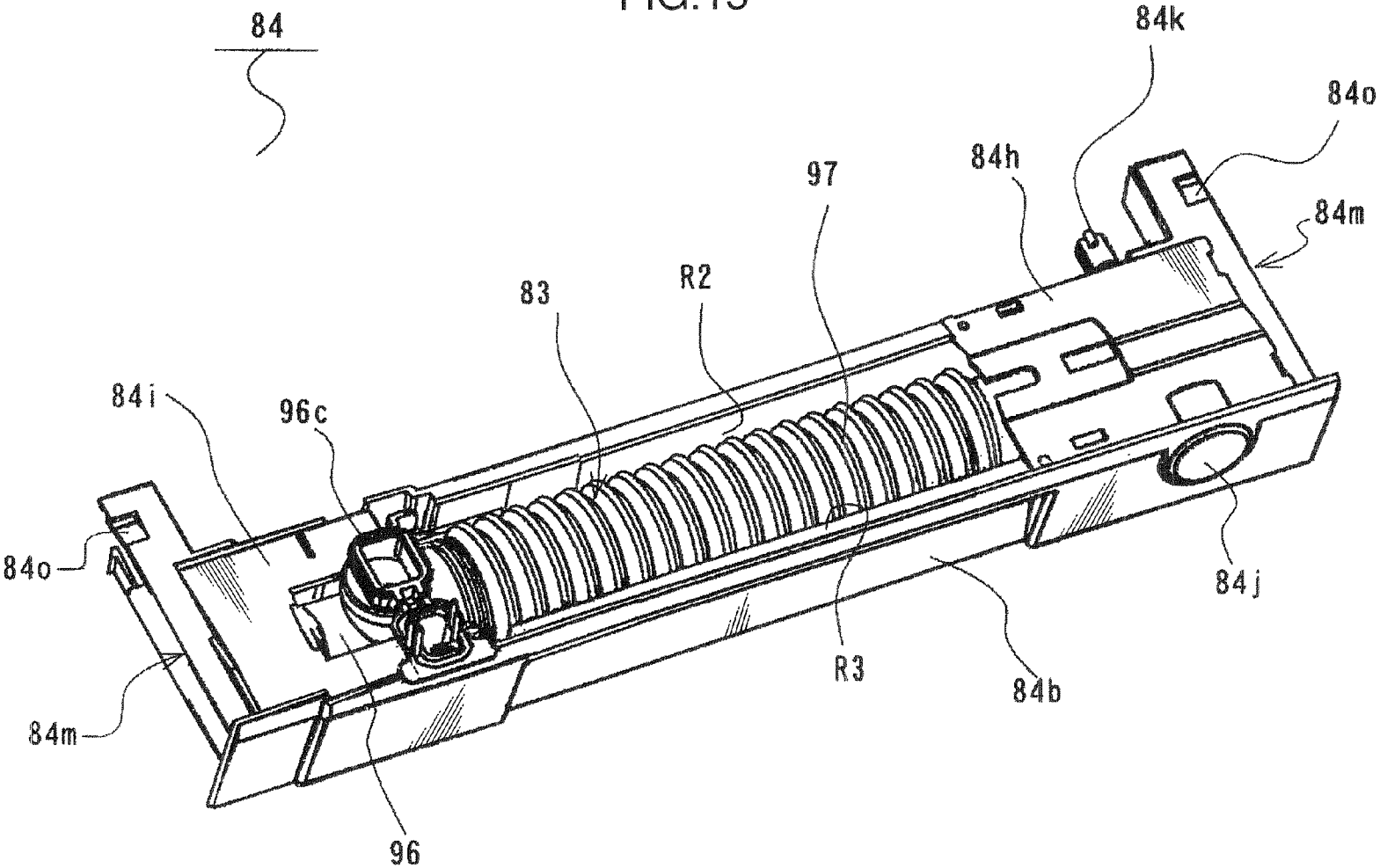
FIG. 15 is a perspective view showing the holder tray in a state after the upper cover is detached therefrom, from the state illustrated in FIG. 14.
Figure 16:
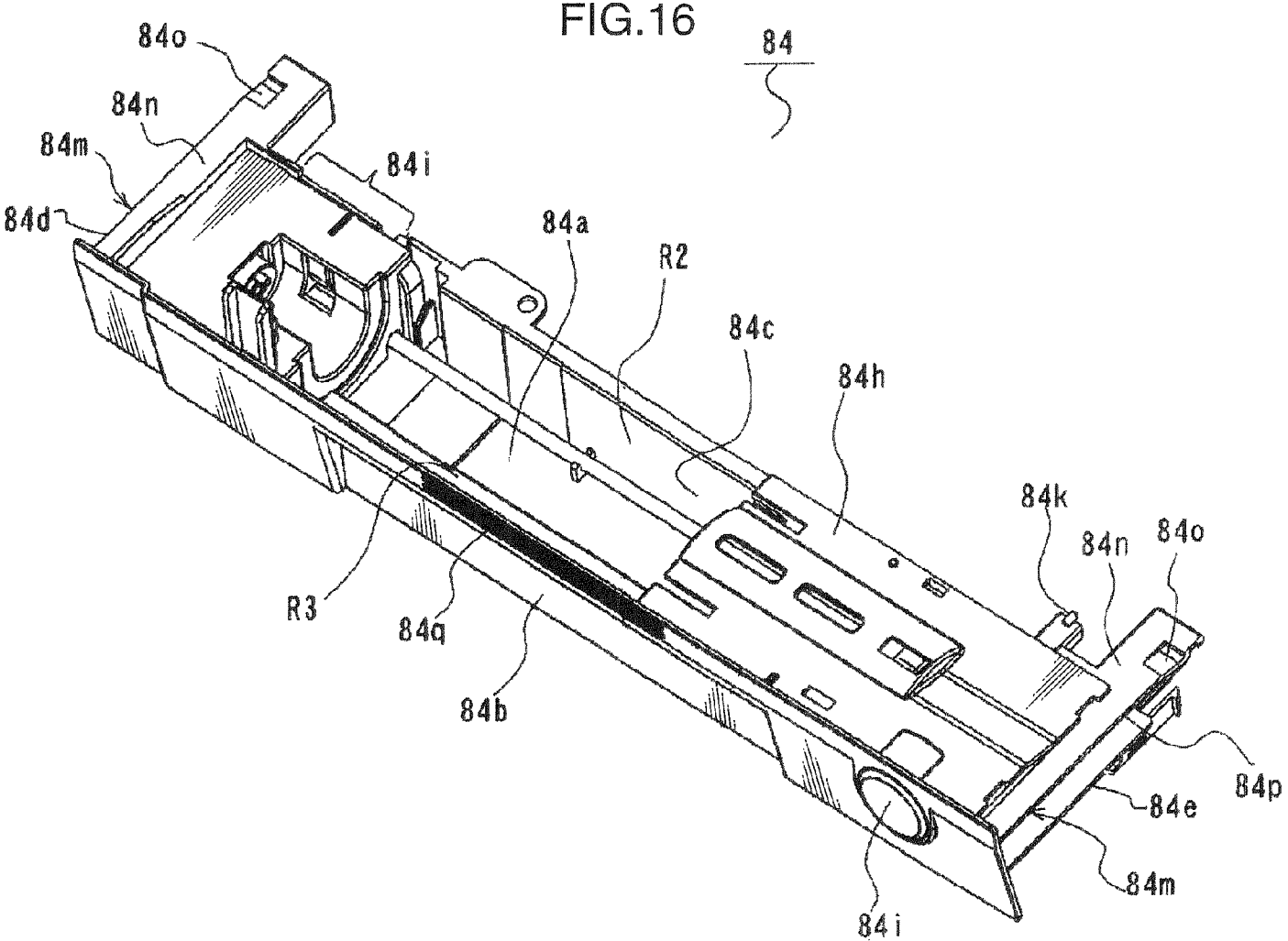
FIG. 16 is a perspective view showing the holder tray in a state after the waste toner container is detached therefrom, from the state illustrated in FIG. 15, when viewed from a rightward and obliquely upward position on the front side thereof.
Figure 17:
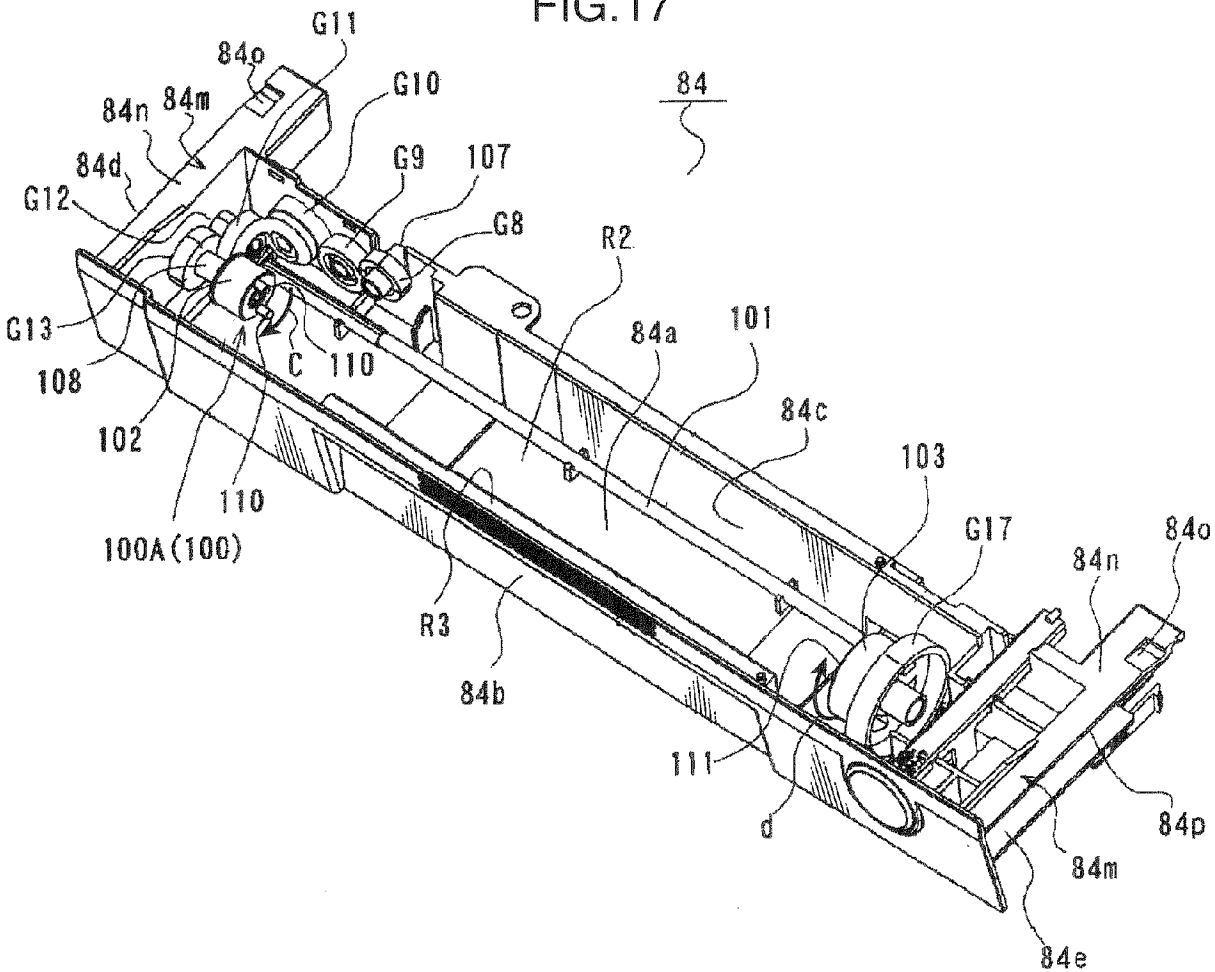
FIG. 17 is a perspective view showing the holder tray in a state after the upper cover and a part of a first positioning portion are further detached therefrom to expose a part of a rotation mechanism for the waste toner container, from the state illustrated in FIG. 16, when viewed from the rightward and obliquely upward position on the front side thereof.

FIG. 14 is a perspective view showing the holder tray 84 which holds the waste toner container 83 and has upper covers 84*f*, 84*g*, 84*h* attached thereto, when viewed from a leftward and obliquely upward position on a front side thereof. FIG. 15 is a perspective view showing the holder tray 84 in a state after the upper covers 84*f*, 84*g* is detached therefrom, from the state illustrated in FIG. 14. FIG. 16 is a perspective view showing the holder tray 84 in a state after the waste toner container 83 is detached therefrom, from the state illustrated in FIG. 15, when viewed from a rightward and obliquely upward position on the front side thereof. FIG. 17 is a perspective view showing the holder tray 84 in a state after the upper cover 84*h* and a part of a first positioning portion 84*i* are further detached therefrom to expose a part of a rotation mechanism 100 for the waste toner container 83, from the state illustrated in FIG. 16, when viewed from the rightward and obliquely upward position on the front side thereof.

As shown in FIG. 17, the holder tray 84 has a bottom plate (bottom portion) 84*a*, a front plate 84*b*, a rear plate 84*c*, a left lateral plate (left lateral wall) 84*d*, and a right lateral plate (right lateral wall) 84*e*, wherein the plates 84*a* to 84*e* are assembled together to define therewithin a storage space R2 for holding the waste toner container 83. An upper end of the storage space R2, i.e., a region surrounded by respective upper edges of the front plate 84*b*, the rear plate 84*c*, the left lateral plate 84*d* and the right lateral plate 84*e*, is formed as a container-replacement opening (container-attaching/detaching opening) R3 oriented upwardly. The waste toner container 83 is attached and detached through the container-replacement opening R3 from approximately above the holder tray 84. Except during an operation of attaching and detaching the waste toner container 83 to/from the holder tray 84, the container-replacement opening R3 is closed by three upper covers 84*f*, 84*g*, 84*h*, as shown in FIGS. 14 to 16, wherein the upper cover 84*h* in FIG. 15 is illustrated in a manner that a left end portion thereof is cut out.

The holder tray 84 has a first positioning portion 84*i* provided on the side of a left end thereof. The first positioning portion 84*i* is adapted to guide an upward-downward movement of a receiving section 96 of the waste toner container 83 during the replacement operation, and position the waste toner container 83 after it is attached to the holder tray 84. Specifically, in a state after the waste toner container 83 is attached to the holder tray 84, it is stored in the storage space R2 in such a manner that the receiving section 96 is located on the side of the left end of the holder tray 84 while being positioned by the first positioning portion 84*i*, and an after-mentioned accumulation section 97 having a bellows-like configuration is arranged to extend in a rightward direction of the apparatus body 10, as shown in FIG. 15.

As shown in FIGS. 14 to 16, the holder tray 84 includes a circular-shaped unlock button 84*j* provided on the side of a right end of a front surface of the front plate 84*b*, and an engagement portion 84*k* connected to the unlock button 84*j* at a position rearward of the unlock button 84*j* and adapted to be disengageably engaged with the retainer body 92. Specifically, when the holder tray 84 is pushed into the retainer body 92 and set in the retracted position C (see FIG. 7), the engagement portion 84*k* is engaged with a portion (not shown) of the retainer body 92 to restrict the holder tray 84 from being drawn out, i.e., lock the holder tray 84. In the locked state, when the unlock button 84*j* is pressed, the engagement between the engagement portion 84*k* and the retainer body 92 is released to enable the holder tray 84 to be drawn out.

As shown in FIG. 17, each of the left lateral plate 84*d* and the right lateral plate 84*e* is provided with a guide plate 84*m* protruding outwardly. The guide plate 84*m* is formed in a flat plate shape which extends approximately horizontally in the frontward-rearward direction to have a rear end protruding rearwardly beyond the rear plate 84*c*. This protruding portion has a downwardly-concaved second depression 84*o* formed in an upper surface thereof. The guide plate 84*m* has a lower surface 84*p* which is supported from therebelow by a rotatable roller member 92*c* (see FIG. 13) provided on the retainer body 92 (apparatus body 10), and an upper surface 84*n* which is guided by a horizontal guide 92*d* provided on the retainer body 92.

As shown in FIG. 13, the roller member 92*c* and the horizontal guide 92*d* are provided on an inner surface of each of a left wall 92*e* and a right wall 92*f* of the retainer body 92. The roller member 92*c* is disposed below and frontward of the horizontal guide 92*d*, and installed in a rotatable manner about a rotation axis oriented in the lateral direction. The roller member 92*c* supports the lower surface of the guide plate 84*m* of holder tray 84, in such a manner that the bottom plate 84*a* of the holder tray 84 is lifted relative to a bottom surface 92*g* (see FIG. 13) of the retainer body 92.

The horizontal guide 92*d* has a lower surface formed as an approximately horizontal guide surface 92*h* for guiding the upper surface 84*n* of the guide plate 84*m* of the holder tray 84. During the operation of drawing out and retracting the holder tray 84, each of the horizontal guides 92*d* comes into slide contact with a corresponding one of the upper surfaces 84*n* of the guide plates 84*m*. More specifically, during the operation of drawing out the holder tray 84 from the retainer unit 80 in the frontward direction and pushing the holder tray 84 into the retainer unit 80 in the rearward direction, each of the lower surfaces 84*p* of the guide plates 84*m* is supported by a corresponding one of the rotatable roller members 92*c*, and each of the upper surfaces 84*n* of the guide plates 84*m* is brought into slide contact with a corresponding one of the guide surfaces 92*h* of the horizontal guides 92*d*, so that the holder tray 84 is kept in an approximately horizontal posture. That is, the holder tray 84 is drawn out and retracted while being kept in an approximately horizontal posture under the condition that the bottom plate 84*a* is lifted relative to the bottom surface 92*g* of the retainer body 92 by the roller members 92*c* and the horizontal guides 92*d*. This makes it possible to allow the holder tray 84 to be smoothly drawn out and retracted from/into the retainer body 92 approximately horizontally in the frontward-rearward direction.

Further, as shown in FIGS. 8 and 9, when the holder tray 84 is drawn out from the retainer body 92 and set in the drawn-out position D, a front end of the holder tray 84 is moved slightly downwardly to incline the entire holder tray 84 obliquely downwardly in the frontward direction. Specifically, as shown in FIG. 13, the horizontal guide 92*d* has an upwardly-concaved first depression 92*i* formed in the guide surface 92*h*. Correspondingly, the downwardly-concaved second depression 84*o* (see FIG. 14) is formed in the upper surface 84*n* of the guide plate 84*m*, as mentioned above. Thus, when the holder tray 84 is drawn out from the retainer body 92 and set in the drawn-out position D, a rear edge of the guide plate 84*m* is fitted into the first depression 92*i* of the horizontal guide 92*d*, and a front edge of the horizontal guide 92*d* is fitted into the second depression 84*o* of the guide plate 84*m*.

That is, as a result of a fitting engagement between the first depressions 92*i* and the second depressions 84*o*, the rear end of each of the guide plates 84*m* is swingingly moved slightly upwardly about a contact position between the guide plate 84*m* and a corresponding one of the roller members 92*c*, and the front end of each of the guide plates 84*m* is slightly moved obliquely downwardly in the frontward direction, so that the holder tray 84 is, as shown in FIG. 8, FIG. 9, FIG. 12, slightly inclined obliquely downwardly in the frontward direction, as a whole. Thus, a direction for attaching/detaching the waste toner container 83 through the container-replacement opening R3 of the holder tray 84 is slightly inclined obliquely downwardly in the frontward direction with respect to a vertical direction. This allows a user to more smoothly attach and detach the waste toner container 83 from the front side of the apparatus body 10.

A user can draw out the holder tray 84 and set in the drawn-out position D by putting his/her fingers on a knob 84*q* formed long at the center of the front plate 84*b* in the lateral direction and pulling the holder tray 84 in the frontward direction. In the drawn-out position D, as mentioned above, the holder tray 84 is inclined obliquely downwardly in the frontward direction, as shown in FIG. 8. Then, when the front plate 84*b* of the holder tray 84 set in the drawn-out position is pushed in the rearward direction, the engagement between corresponding ones of the guide plates 84*m* and the horizontal guides 92*d* through the first depressions 92*i* and the second depressions 84*o* is be released to allow the holder tray 84 to be moved in the rearward direction and set in the retracted position C.

(Waste Toner Container)

When the holder tray 84 is set in the retracted position C illustrated in FIG. 7, the waste toner container 83 is set in a collection position A for allowing for receiving waste toner dropped down (discharged) from the second outlet port 82*d* of the second transport section 82. Then, when the holder tray 84 is set in the drawn-out position D illustrated in FIGS. 8 and 9, the waste toner container 83 is set in a replacement position B for allowing the replacement operation to be performed through the container-replacement opening R3 from above the holder tray 84.

As shown in FIG. 15, the waste toner container 83 includes a receiving section 96 and an accumulation section 97. The receiving section 96 is located on a left side in FIG. 15 under a condition that the waste toner container 83 is held in the holder tray 84, i.e., in the state after the waste toner container 83 is set in the retracted position R2 in the holder tray 84. The accumulation section 97 is rotatably engaged with a right end of the receiving section 96, and arranged to extend in the rightward direction.

Figure 18:
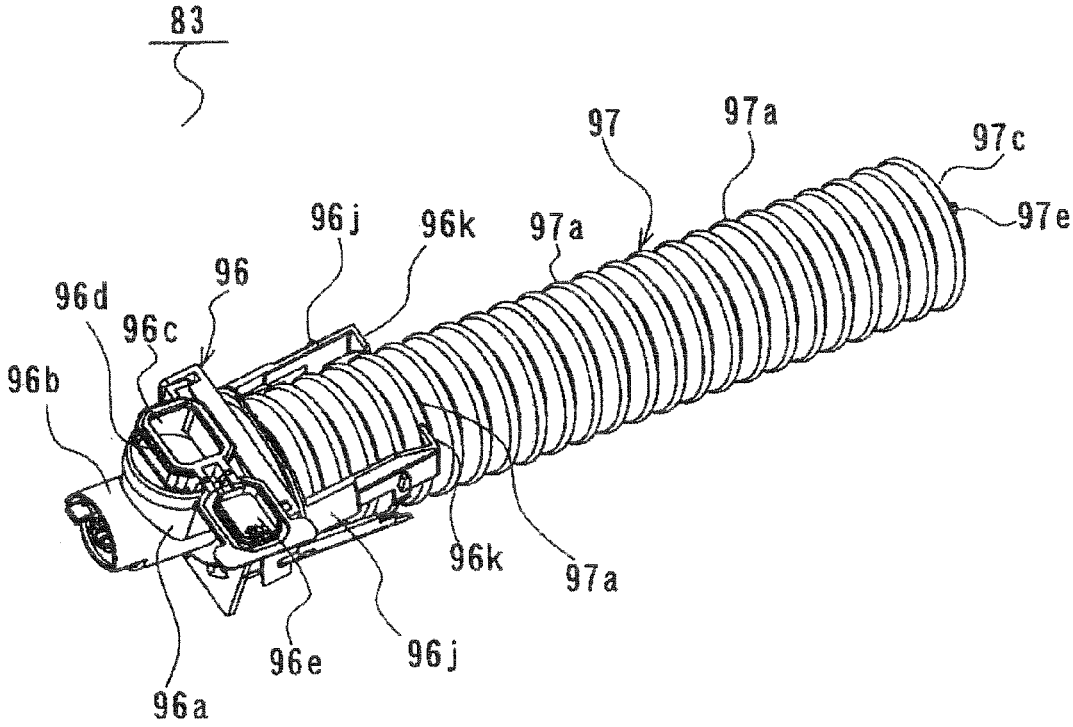
FIG. 18 is a perspective view showing the waste toner container, when viewed from a leftward and obliquely upward position on a front side thereof.
Figure 19A:
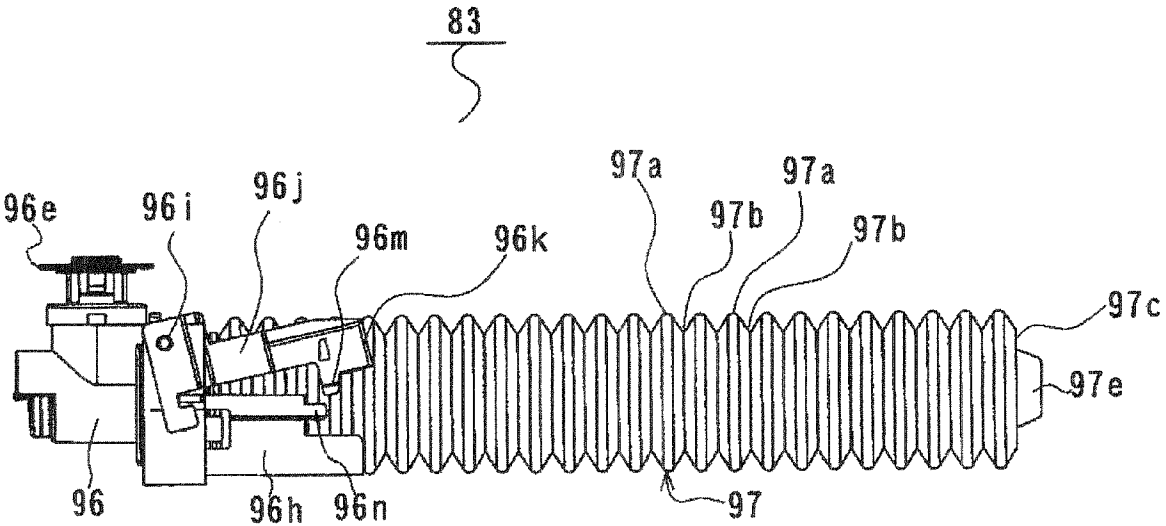
FIG. 19A is a front view showing the waste toner container.
Figure 19B:
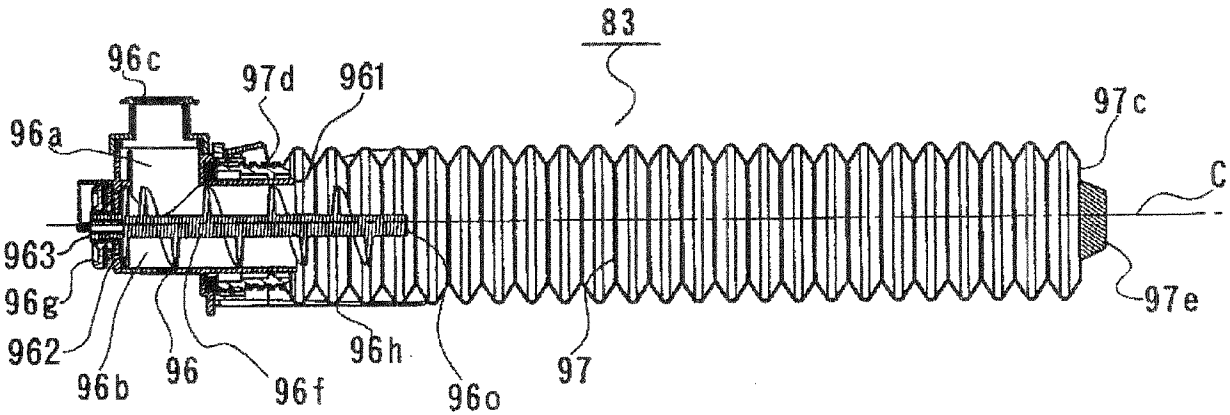
FIG. 19B is a vertical sectional view taken along an axis (rotation axis) of an accumulation section of the waste toner container.

FIGS. 18, 19A and 19B show a structure of the waste toner container 83. FIG. 18 is a perspective view showing the waste toner container 83, when viewed from a leftward and obliquely upward position on a front side thereof. FIG. 19A is a front view showing the waste toner container 83, and FIG. 19B is a vertical sectional view taken along an axis C (rotation axis) of the accumulation section 97 of the waste toner container 83.

In the waste toner container 83 illustrated in FIGS. 18, 19A and 19B, the receiving section 96 is adapted to receive waste toner dropped down from the second transport section 82, and the accumulation section 97 is formed in a generally cylindrical shape and a bellows-like configuration, and rotatably attached to the right end of the receiving section 96. As shown in FIG. 19B, the receiving section 96 includes a heightwise transport passage 96*a* extending in an upward-downward direction, and a lateral transport passage 96*b* provided below the heightwise transport passage 96*a* in a coupled manner to extend in the rightward-leftward (lateral) direction.

As shown in FIG. 18, the heightwise transport passage 96*a* has a generally rectangular-shaped inlet port 96*c* provided in an upper end thereof and opened upwardly, and a flange 96*d* formed around the inlet port 96*c*. The heightwise transport passage 96*a* is provided with a lid member 96*e* attached to the flange 96*d* to openably close the inlet port 96*c*.

As shown in FIG. 19B, the lateral transport passage 96*b* is formed in a generally cylindrical shape which has an edge of a first end 96*l* located on one side coupled with the accumulation section 97 and formed as an open end, and an edge of a second end 962 located on the other side opposite to the first end 96*l* and formed as a closed end. The waste toner container 83 further includes a transport screw 96*f* and a first coupling 96*g*. The transport screw 96*f* is disposed inside the lateral transport passage 96*b*. The transport screw 96*f* has a left end (second end) 963 which penetrates through the edge of the second end 962 in the leftward direction and protrude from the edge of the second end 962. The first coupling 96*g* is fixed to a distal edge of the left end 963, and engaged with two engagement pins 110 of a first rotation member 102 of an after-mentioned rotation mechanism 100 (see FIG. 17) for the waste toner container 83, so as to transmit torque from the engagement pins 110 to the transport screw 96*f* therethrough. The transport screw 96*f* is formed to extend in the rightward direction beyond the edge of the second end 962 on a right side of the lateral transport passage 96*b* so that a right end (first end) 96*o* thereof is located inside the accumulation section 97. The waste toner container 83 further includes a rotation guide 96*h* and a pair of arms (arm members) 96*j*. The rotation guide 96*h* is formed to have a semicircular shape in a cross-section taken along a plane perpendicular to the lateral direction, and attached to an outer peripheral surface of the lateral transport passage 96*b*. The rotation guide 96*h* is adapted, when the accumulation section 97 is rotated, to guide the rotation of the accumulation section 97 while supporting a left end (open end) of the accumulation section 97.

The arms 96*j* are attached onto respective upper regions of a front half and a rear half of a peripheral surface of the lateral transport passage 96*b* in a swingable manner about a swing axis 96*i*. As shown in FIG. 18, each of the arms 96*j* is provided with a pawl 96*k* at a distal (right) end thereof. Each of the pawls 96*k* is configured to slightly press at least one of a plurality of large-diameter portions 97*a* of the accumulation section 97 having the bellows-like configuration, from an obliquely upward position with respect to a respective one of front and rear edges of the large-diameter portion 97*a*, so as to stoppably contact the large-diameter portion 97*a*. Specifically, each of the arms 96*j* is adapted to be movable between a first posture allowing the pawls 96*j* to stoppably contact the large-diameter portion, and a second posture allowing the contact state to be released. Thus, the accumulation section 97 is kept from dropping-off from the receiving section 96 while being rotatably supported and guided, by the rotation guide 96*h*, and the pawls 96*k* of the arms 96*j*.

As shown in FIG. 19A, each of the arms 96*j* has a lower end formed with a hook 96*m*. Correspondingly, the rotation guide 96*h* has an upper end formed with a catch portion 96*n*. Thus, in the unused spare waste toner container 83, the accumulation section 97 can be shortened (compressed) along an axis C to an extent that an edge of a right end (closed end) 97*c* of the accumulation section 97 is kept from contacting the right end 96*o* of the transport screw 96*f*, and then each of the arms 96*j* can be slightly swingingly moved downwardly to bring the hook 96*m* into engagements with the latch portion 96*n* so as to allow the pawls 96*k* to lock the edge of the right end 97*c* of the shortened accumulation section. Through this operation, the shortened state of the accumulation section 97 can be maintained.

The shortened unused spare waste toner container 83 is stored as a replacement spare in the storage space R1 in a lower region on the side of a right end of the retainer body 92, as shown in FIG. 10. Specifically, the waste toner container 83 is configured to prevent the right end 97*c* of the accumulation section 97 from contacting the right end 96*o* of the transport screw 96*f*, even when it is shortened into a size capable of being stored in the storage space R1. In other words, each of the pair of arms 96*j* has a length for allowing the edge of the right end 97*c* of the shortened accumulation section 97 to be kept from contacting the right end 96*o* of the transport screw 96*f*.

As shown in FIG. 19A, the accumulation section 97 is formed in a cylindrical shape having a plurality of large-diameter portions 97*a* and a plurality of small-diameter portions 97*b* which are alternately arranged along the axis C, i.e., in a so-called stretchable/shortenable bellows-like configuration. The accumulation section 97 has the open end (left end) coupled to the receiving section 96, and the closed end (edge of the right end 97*c*) located on the opposite side of the open end. In place of the bellows-like configuration, the accumulation section 97 may have a spiral or helical configuration. In this case, a helical angle/direction may be set to allow waste toner to be transported toward an inward side of the accumulation section 97 according to a rotation of the accumulation section 97.

As shown in FIG. 19B, the accumulation section 97 has a coupling portion 97*d* (which is one rotary member) provided at the left end (open end) and rotatably engaged with an outer periphery of the edge of the first end 961 of the lateral transport passage 96*b* of the receiving section 96. Further, the accumulation section 97 has a trapezoidal plate-shaped second coupling 97*e* (which is a rotational retainer, and one rotary member) provided on an outer edge of the right end 97*c* of the accumulation section 97 to protrude in the right direction. When the second rotation member 103 is rotated under a condition that the second coupling 97*e* is engaged with a slit (not shown) of an after-mentioned second rotation member 103, the accumulation section 97 is rotated through the second coupling 97*e*.

In this embodiment, the waste toner container 83 is designed to rotate not only the transport screw 96*f* installed in the receiving section 96 to transport waste toner, but also the accumulation section 97 for accumulating waste toner. Thus, waste toner is evenly stored along a longitudinal direction of the accumulation section 97 without being locally accumulated in the accumulation section 97. This makes it possible to increase an amount of practically collectable waste toner of the waste toner container 83, as compared with case where the accumulation section 97 is not rotated.

(Rotation Mechanism for Waste Tonner Container)

With reference to FIGS. 17 and 20 to 23, a rotation mechanism 100, which is a mechanism for rotating the transport screw 96*f* and the accumulation section 97 of the waste toner container 83, will be described below. The rotation mechanism 100 includes seventeen gears G1 to G17 (see FIG. 21), a shaft 101 arranged to extend in the rightward-leftward (lateral) direction, a first rotation member 102 disposed adjacent to a left end of the shaft 101, and a second rotation member 103 disposed adjacent to a right end of the shaft 101. Among the gears G1 to G17, the four gears G2, G3, G10, G11 are bevel gears for changing a rotation direction by 90 degrees between two of them, and each of the remaining gears is a spur gear.

Figure 20:
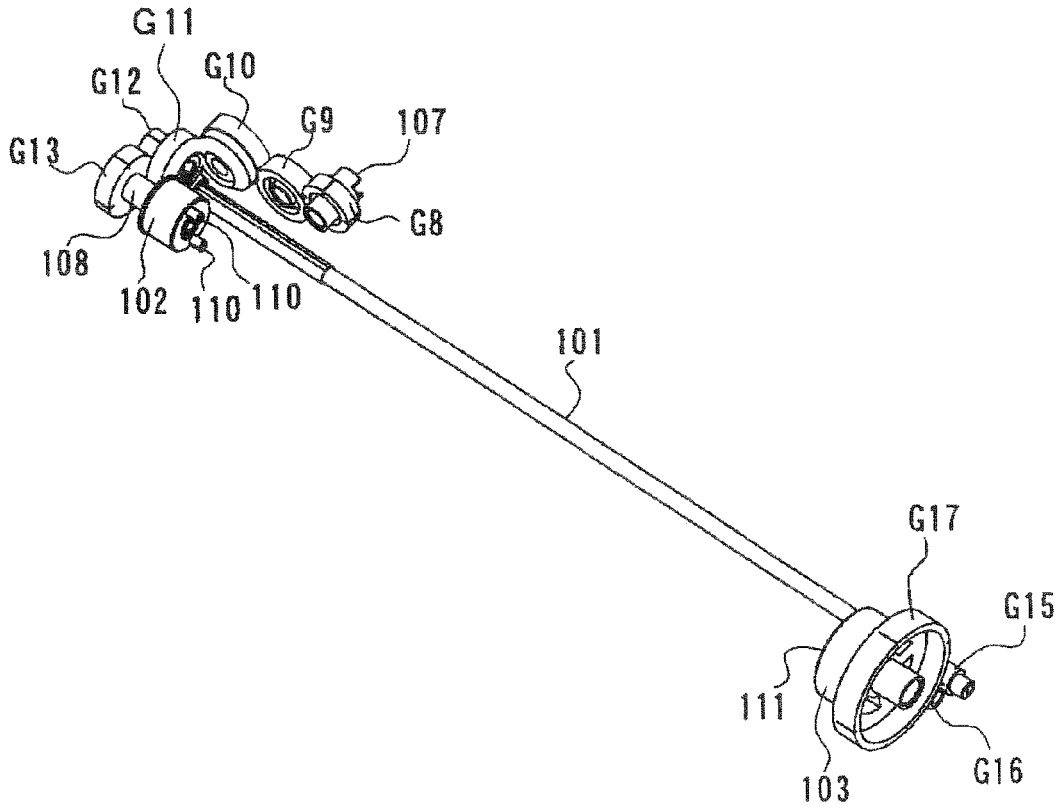
FIG. 20 is a perspective view showing specific components to be arranged within the holder tray illustrated in FIG. 17, which are extracted from a plurality of components of the rotation mechanism.
Figure 21:
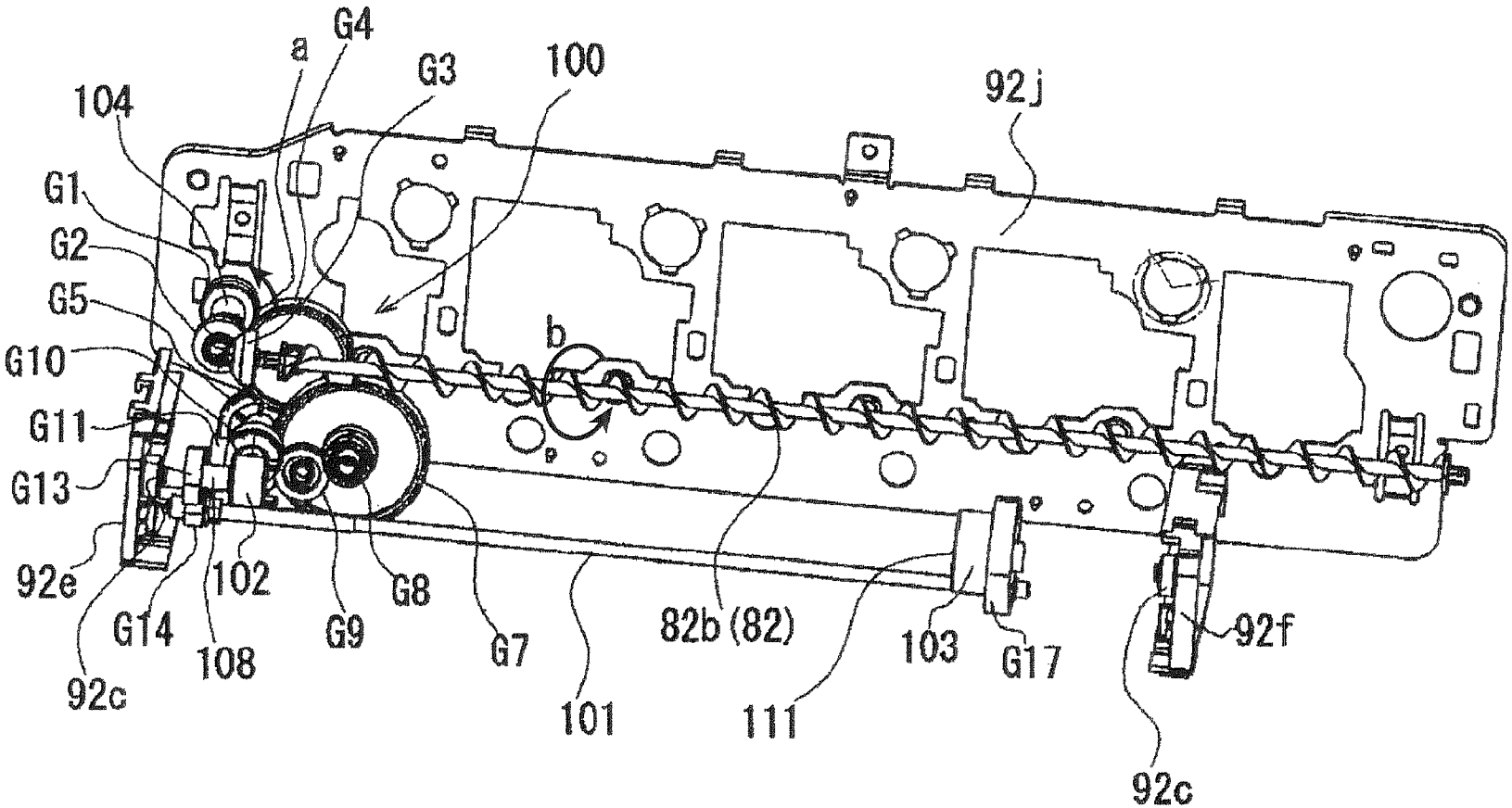
FIG. 21 is a perspective view generally showing the rotation mechanism.
Figure 22:
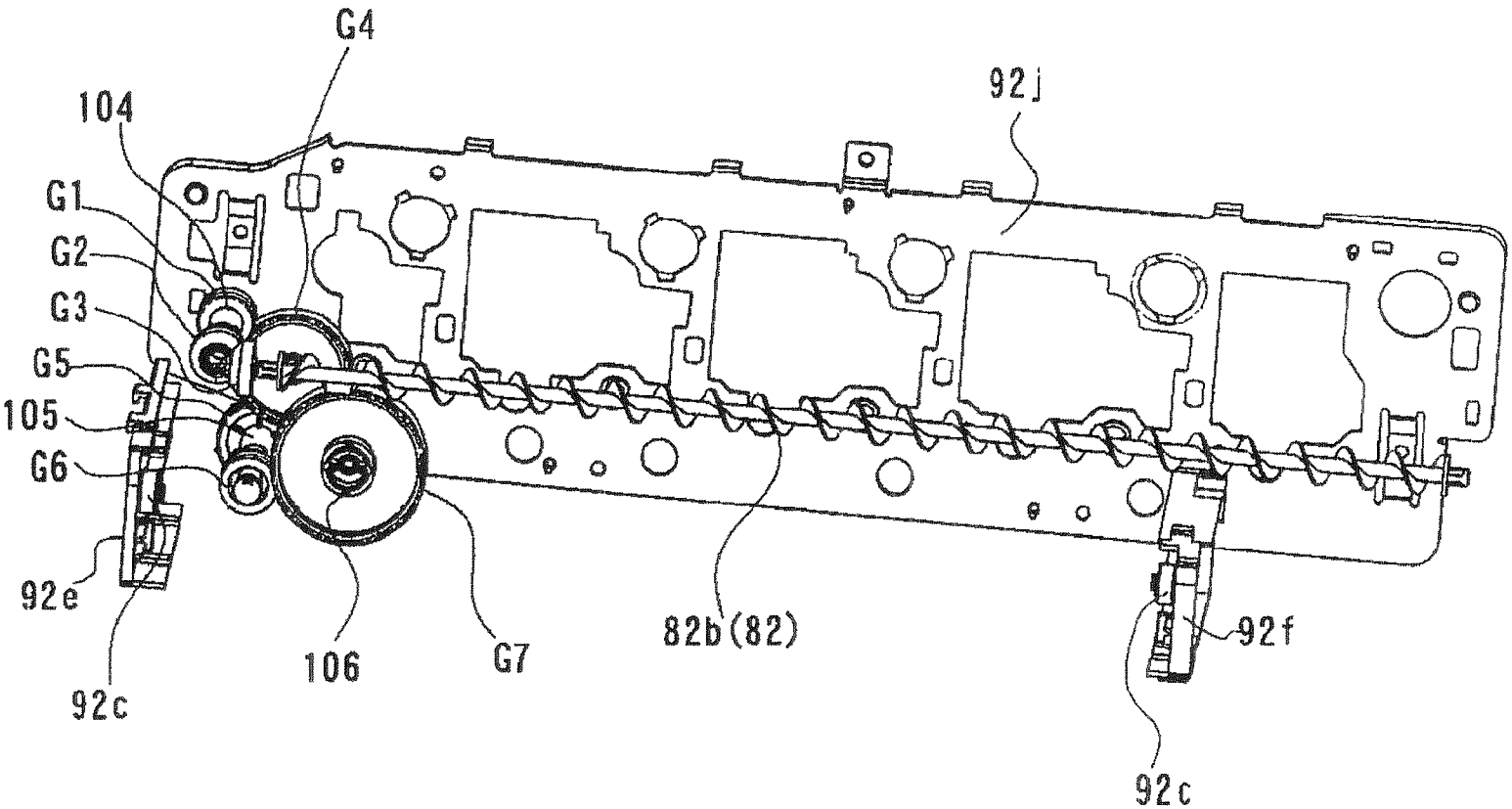
FIG. 22 is a perspective view showing specific components to be arranged in a retainer body, among the components of the rotation mechanism.
Figure 23:
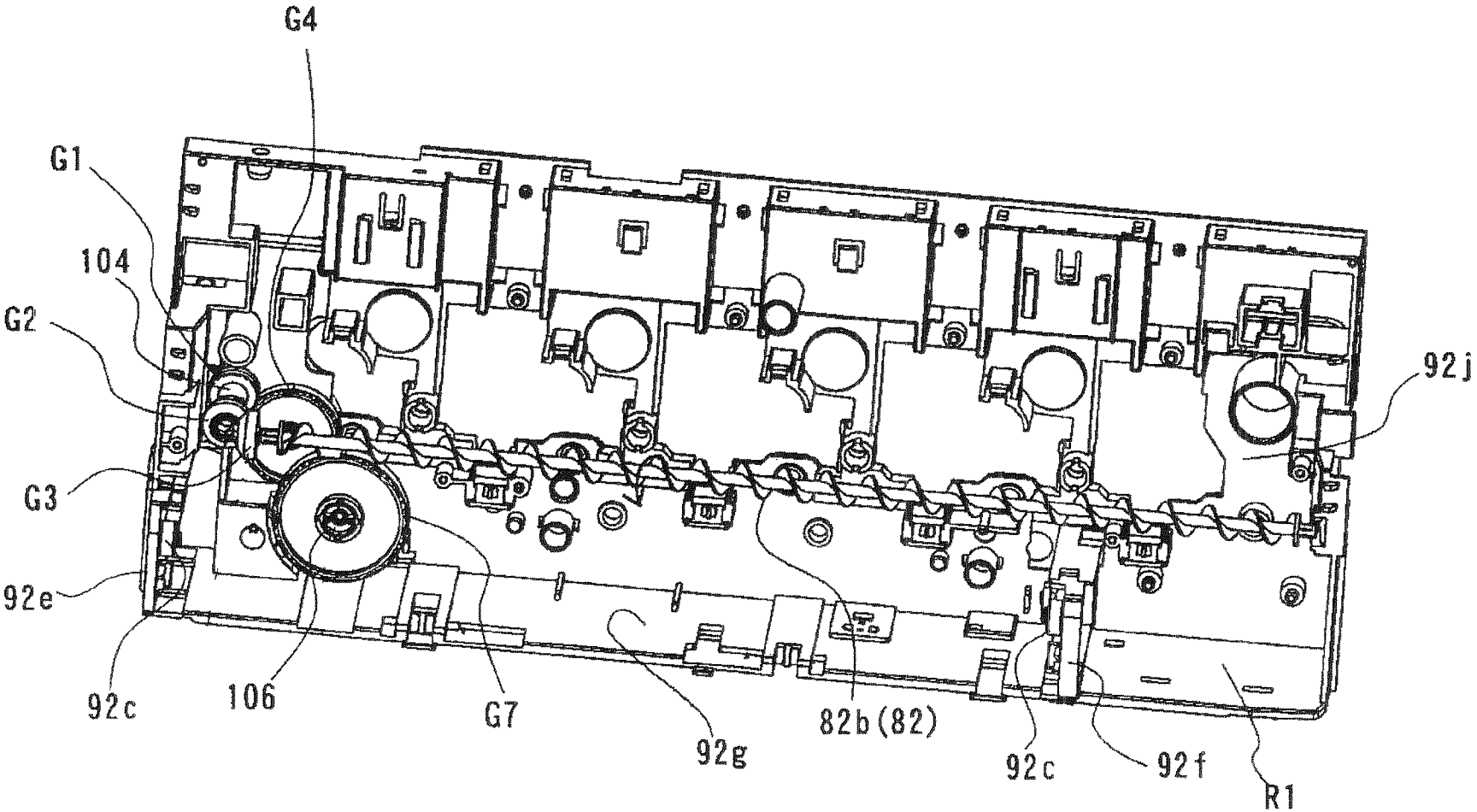
FIG. 23 is an explanatory perspective view showing a state after gears G5, G6 are detached from the rotation mechanism illustrated in FIG. 22.

The rotation mechanism 100 is specifically illustrated in FIGS. 20 to 23, wherein: FIG. 20 is a perspective view showing specific components to be arranged within the holder tray 84 illustrated in FIG. 17, which are extracted from a plurality of components of the rotation mechanism 100 (rotation mechanism 100A incorporated in the holder tray 84); FIG. 21 is a perspective view generally showing the rotation mechanism 100; FIG. 22 is a perspective view showing specific components to be arranged in the retainer body 92, among the components of the rotation mechanism 100; and FIG. 23 is an explanatory perspective view showing a state after the gears G5, G6 are detached from the rotation mechanism 100 illustrated in FIG. 22. In this embodiment, a waste toner-accumulating structure includes the waste toner container 83, the holder tray 84, and the rotation mechanism 100A incorporated in the holder tray 84, which is a part of the rotation mechanism 100.

As shown in FIG. 21, the gear G1 is provided in a lower region on the side of a left end of a front (inner) surface of the rear plate 92*j* of the retainer body 92, and arranged to have a rotation axis extending in the frontward-rearward direction. The gear G1 is adapted to be connected to a driving source for a sheet transport system provided in the apparatus body 10, through a driving-force transmission mechanism, a coupling, etc. (not shown), when the image-forming-module frame 78 illustrated in FIG. 6 is retracted into the apparatus body 10, under a condition that the development devices 38*a* to 38*d*, the drum units 39*a* to 39*d*, the retainer unit 80, are attached to the image-forming-module frame 78.

The gear G1 is connected to the gear G2 through a shaft 104 (see FIG. 22). The gear G2 is meshed with the gear G3. The gear G3 is fixed to a left end of the second transport screw 82*b* arranged to extend in the lateral direction. As shown in FIG. 22, the gear G1 is meshed with the gear G4 disposed on a right side thereof, and the gear G4 is meshed with the gear G5 disposed therebelow. The gear G5 is connected to the gear G6 through a shaft 105. The gear G6 is meshed with the gear G7 disposed on a right side thereof. As shown in FIG. 23, a coupling 106 is formed on the side of a front surface of the gear G7. All the gear G1 to G7 and the second-transport screw 82*b* are arranged in the retainer body 92, i.e., outside the holder tray 84.

As shown in FIGS. 17 and 20, the gear G8 is arranged in the holder tray 84, and formed with a coupling 107 oriented in the rearward direction. The coupling 107 is adapted, when the holder tray 84 is pushed into the retainer body 92 and set in the retracted position C, to be engaged with the gear G7. As shown in FIGS. 17, 20 and 21, the gear G8 is meshed with the gear G9 disposed on a left side thereof. The gear G10 is prepared by integrally forming a bevel gear portion and a spur gear portion together, and disposed on a left side of the gear G9. The gear G9 is meshed with the spur gear portion of the gear G10. The bevel gear portion of the gear G10 is meshed with the gear G11. As shown in FIGS. 17 and 20, the gear G11 is integrally formed with the gear G12 having a relatively small diameter. The gear G12 is meshed with the gear G13 disposed on a front side thereof. The gear G13 is connected to the first rotation member 102 through a shaft 108 arranged to extend in the rightward direction.

The gear G12 illustrated in FIGS. 17 and 20 is meshed with the gear G14 illustrated in FIG. 21, in addition to the gear G13. The gear G14 is fixed to a left end of a shaft 101 arranged to extend in the lateral direction. As shown in FIG. 20, the gear G15 is fixed to a right end of the shaft 101. The gear G15 is meshed with the gear G16 disposed on a front side thereof. The gear G16 is meshed with the gear G17. The second rotation member 103 is fixed onto a left lateral surface of the gear G17.

As shown in FIGS. 17 and 20, the first rotation member 102 is formed in a cylindrical shape which has a right lateral surface provided with two engagement pins 110 at respective symmetric positions with respect to a rotational axis thereof to extend in the rightward direction. The two engagement pins 110 are adapted to come into engagement with the first coupling 96*g* provided at the left end 963 of the transport screw 96*f* illustrated in FIG. 19B, when the receiving section 96 of the waste toner container 83 is fittingly engaged with and positioned by the first positioning portion 84*i* of the holder tray 84 during the operation of attaching the waste toner container 83 to the storage space R2 of the holder tray 84 illustrated in FIGS. 15 and 16. This makes it possible to transmit a rotation (torque) of the first rotation member 102 being rotationally driven, to the transport screw 96*f* through the engagement pins 110 and the first coupling 96*g*.

The second rotation member 103 illustrated in FIGS. 17, 20 and 21 is formed in a cylindrical shape which has a left lateral surface 111 formed with a slit (not shown) extending in a diametral direction thereof. The slit of the second rotation member 103 is adapted, during the operation of storing the waste toner container 83 into the storage space R2 of the holder tray 84, to allow the plate-shaped second coupling 97*e* (see FIGS. 19A and 19B) provided on the edge (outer edge) of the right end 97*c* of the accumulation section 97 to be inserted thereinto. This makes it possible to transmit a rotation of the second rotation member 103 being rotationally driven, to the accumulation section 97.

In the above rotation mechanism 100, when the driving source for the sheet transport system (driving source provided in the apparatus body 10) is rotationally activated, a rotation of the driving source is transmitted as a rotation in the arrowed direction "a" to the gear G1 illustrated in FIG. 21, through the driving-force transmission mechanism and others (not shown). Then, when the gear G1 is rotated in the arrowed direction "a", the second transport screw 82*b* is rotated in the arrowed direction "b" through the gears G2, G3. Thus, according to a rotation of the second transport screw 82*b*, waste toner is transported within the second transport passage 82*a* illustrated in FIG. 10, in a direction from the right lateral surface 92*a* to the left lateral surface 92*b* of the retainer body 92.

Further, when the gear G1 is rotated in the arrowed direction "a", the first rotation member 102 illustrated in FIG. 17 is rotated in the arrowed direction "c" through the gears G4 to G13. According to the rotation of the first rotation member 102, the transport screw 96*f* in the waste toner container 83 illustrated in FIG. 19B is rotated in the arrowed direction "c" in FIG. 17, and thereby waste toner in the receiving section 96 is transported toward the accumulation section 97.

Concurrently, the second rotation member 103 illustrated in FIG. 17 is rotated in the arrowed direction "d" through the gears G4 to G12, G14 to G17. The rotation of the second rotation member 103 is transmitted to the accumulation section 97 of the waste toner container 83 through the second coupling 97*e*. Thus, the accumulation section 97 is rotated in the arrowed direction "d" in FIG. 17 to assist the waste toner transported toward the accumulation section 97 by the transport screw 96*f*, in being further transported toward a right end (inward side) of the accumulation section 97.

(Function/Advantage of Waste Toner Collection System)

In the above waste toner collection system 1, for example, when a user attaches the waste toner container 83 to the holder tray 84, the door 4 on the front surface 10*a* of the apparatus body 10 illustrated in FIG. 1 is first opened to expose the front surface of the retainer unit 80. At this moment, the holder tray 87 is in the retracted position C where it is retracted in the retainer body 92 (apparatus body 10), and in the locked state precluding the draw-out thereof, as shown in FIG. 7.

Then, when the user presses the unlock button 84*i* on the front surface of the holder tray 84, the locked state is released to enable the draw-out of the holder tray 84. The holder tray 84 is drawn out approximately horizontally in the frontward direction. During this operation, the holder tray 84 is smoothly drawn out approximately horizontally while being guided in such a manner that the bottom plate 84*a* illustrated in FIG. 17 is lifted from the bottom surface 92*g* of the retainer body 92 illustrated in FIG. 13 and kept in an approximately horizontal posture. Thus, even if waste toner is attached on the bottom surface 92*g* of the retainer body 92, the above structure can prevent contamination of the holder tray 84 due to rubbing of the waste toner between the bottom surface 92*g* of the retainer body 92 and the bottom plate 84*a* of the holder tray 84.

Then, when the holder tray 84 is set in the drawn-out position D as shown in FIGS. 8 and 9, the holder tray 84 has a frontwardly-inclined posture where it is slightly inclined obliquely downwardly in the frontward direction, as described above. This makes it possible to facilitate the operation of attaching and detaching the waste toner container 83 to the storage space R2 of the holder tray 84 from above the container-replacement opening R3, as shown in FIG. 15. In the operation of attaching the waste toner container 83 to the holder tray 84, the entire waste toner container 83 is stored in the storage space R2 while allowing the receiving section 96 of the waste toner container 83 to be engageably fitted into the first positioning portion 84*i* of the holder tray 84 from above. A position of the waste toner container 83 in this state is the replacement position B. The waste toner container 83 set in the replacement position B is placed in a state capable of a rotation transmission from the first rotation member 102 of the rotation mechanism 100 illustrated in FIG. 17 to the transport screw 96*f* (see FIG. 9B), and a rotation transmission from the second rotation member 103 of the rotation mechanism 100 to the accumulation section 97.

The holder tray 84 in the drawn-out position D illustrated in FIGS. 8 and 9 can be pushed into the retainer body 92 approximately horizontally so as to be set in the retracted position C illustrated in FIG. 7. In the retracted position C, the inlet port 96*c* of the waste toner container 83 illustrated in FIG. 18 is brought into close contact with the second outlet port 82*d* of the second transport passage 82*a* illustrated in FIG. 10. Further, the gear G8 provided in the holder tray 84 is brought into mesh engagement with the gear G7 provided in the retainer body 92, as shown in FIG. 21. Thus, in the rotation mechanism 100 is placed in a state capable of a rotation transmission from the driving source provided in the apparatus body 10 for the sheet transport system, to each of the second transport screw 82*b* in the retainer body 92, and the first and second rotation members 102, 103 in the holder tray 84.

In this state, when a main switch of the image forming apparatus 2 is turned on, and the driving source (not shown) for the sheet transport system is rotationally activated, the first transport screws 42*d* of the first transport section 81 and the second transport screw 82*b* of the second transport section 82 are rotated, and further the transport screw 96*f* and the accumulation section 97 of the waste toner container 83 are rotated. Along with an increase in the number of image forming cycles for sheets, a toner failing to be transferred will be increasingly left as non-transferred toner on the surfaces of the photosensitive drums 36 and the surface of the intermediate transfer belt 41. The non-transferred toner on the surfaces of the photosensitive drums 36 is removed as waste toner by the drum cleaners 42, and the non-transferred toner on the surface of the intermediate transfer belt 41 is removed as waste toner by the belt cleaner 48.

The waste toner removed from the photosensitive drums 36 and the intermediate transfer belt 41 is transported in the frontward direction of the apparatus body 10 through the first transport section 81, and dropped down from the first outlet ports 91*f*, so that the waste toner is received in the second transport section 82. The received waste toner is transported in the leftward direction of the apparatus body 10, and dropped down from the second outlet port 82*d*, so that the waste toner is received in the receiving section 96 of the waste toner container 83 through the inlet port 96*c*.

In the waste toner container 83, the transport screw 96*f* is being rotated, and further the accumulation section 97 is being rotated. Thus, the waste toner dropped down into the waste toner container 83 is transported toward the accumulation section 97 by the transport screw 96*f*, and then gradually transported toward the right end of the accumulation section 97 according to the rotation of the accumulation section 97 without being locally accumulated in the accumulation section 97.

Along with an increase in the number of image forming cycles, an amount of waste toner to be collected to the waste toner container 83 will be increased. When a waste toner sensor (not shown) installed adjacent to the receiving section 96 detects a fact that the amount of waste toner in the waste toner container 83 becomes greater than a predetermined value, the information is indicated on the manual operation panel 7 (see FIG. 1) of the apparatus body 10.

According to the indication, a user will perform a replacement operation of replacing the waste toner container 83. In the replacement operation, the user opens the door 4 (see FIG. 1) of the apparatus body 10 to expose the retainer unit 80 illustrated in FIG. 7, and then presses the unlock button 84*j* of the holder tray 84 to release the locked state of the holder tray 84 relative to the retainer body 92.

Then, the user draws out the holder tray 84 set in the retracted position C, in the frontward direction, and set in the drawn-out position D illustrated in FIGS. 8 and 9. During this operation, the holder tray 84 can be smoothly drawn out approximately horizontally without rubbing waste toner. In addition, the holder tray 84 set in the drawn-out position D has a frontwardly-inclined posture, so that the container-replacement opening R3 is slightly inclined obliquely downwardly in the frontward direction, with respect to a vertical direction. Thus, the user who performs the replacement operation from the front side of the apparatus body 10 can readily take out the waste toner container 83 upwardly through the container-replacement opening R3.

Subsequently, the user takes out the new spare waste toner container 83 stored in the storage space R1 (see FIG. 10) just on the right side of the holder tray 84. After releasing the arms 96*j* to stretch the accumulation section 97 in the shortened state, the user attaches the spare waste toner container 83 to the holder tray 84 set in the drawn-out position D, from above through the container-replacement opening R3. After completion of the attaching operation, the user pushes the holder tray 84 approximately horizontally in the rearward direction to set the holder tray 84 in the retracted position C. Thus, the waste toner container 83 is set in the collection position A where the inlet port 96*c* is aligned with the second outlet port 82*d* of the second transport passage 82*a*, to enable the collection of waste toner.

Although the present invention has been described based on a specific embodiment thereof, it is understood that the present invention may be applied to various types of collection systems for removing and collecting fine particles attached on a member.

The above specific embodiment primarily includes an invention having the following features.

According to one aspect of the present invention, there is provided a waste toner container for collecting waste toner removed from an image bearing member, which comprises: a receiving section adapted to introduce the waste toner from an inlet port provided in an upper region thereof, and receive therein the waste toner dropped down through the inlet port; an accumulation section arranged to extend from the receiving section in a lateral direction approximately perpendicular to a dropping direction of the waste toner, and rotatably coupled to the receiving section; and a rotary member adapted to allow for rotation of the accumulation section.

In the waste toner container of the present invention, the accumulation section can be rotated to allow waste toner to be transported in the lateral direction, i.e., a longitudinal direction thereof. This makes it possible to transport waste toner toward a longitudinally inward side of the waste toner container.

Preferably, the waste toner container of the present invention further comprises: a transport screw provided in the receiving section, and adapted to transport the received waste toner dropped from the inlet port and received by the receiving section, toward the accumulation section; and a first coupling fixed to the transport screw, and adapted to receive a torque transmitted from outside the waste toner container.

According to this feature, the transport screw can be rotated through the first coupling to allow waste toner to be transported from the receiving section toward the accumulation section. This makes it possible to prevent waste toner from being piled up at a position just below the inlet port so as to effectively accumulate waste toner in the accumulation section.

Preferably, in this waste toner container, the receiving section includes a heightwise transport passage extending in an upward-downward direction, and a lateral transport passage provided below the heightwise transport passage in a coupled manner, and arranged to extend the lateral direction, wherein: the inlet port is provided at an upper end of the heightwise transport passage, the lateral transport passage has an edge of a first end located on one side coupled with the accumulation section and formed as an open end, and an edge of a second end located on the other side opposite to the first end and formed as a closed end; the transport screw is disposed inside the lateral transport passage in such a manner as to have a first end protruding from the edge of the first end, and a second end located on an opposite side of the first end to protrude from the edge of the second end; and the first coupling is attached to a distal edge of the second end of the transport screw.

According to this feature, waste toner introduced and dropped from the heightwise transport passage can be transported to the accumulation section according to a rotation of the transport screw disposed inside the lateral transport passage.

Preferably, in the waste toner container of the present invention, the rotary member includes a second coupling which is integrally provided in the accumulation section, and adapted to receive a torque transmitted from outside the waste toner container.

According to this feature, the accumulation section is rotated through the second coupling to make it easier for waste toner transported to the accumulation section to be moved toward the inward side of the accumulation section. This makes it possible to more effectively accumulate the waste toner in the accumulation section.

Preferably, in the waste toner container of the present invention, the accumulation section is formed in a generally cylindrical shape which has an open end coupled to the receiving section, and an closed end located on an opposite side of the open end, wherein the second coupling is provided on an outer surface of the closed end.

According to this feature, a force for rotating the accumulation section can be transmitted through the second coupling provided on the closed end to simplify a rotary mechanism.

Preferably, in the above waste toner container, the accumulation section is formed in a generally cylindrical shape which has an open end coupled to the receiving section, and an closed end located on an opposite side of the open end, wherein the second coupling is provided on an outer surface of the closed end, and a coupling portion is provided at the open end and rotatably engaged with an outer periphery of the edge of the first end of the lateral transport passage.

According to this feature, a force for rotating the accumulation section is transmitted from the side of one end (closed end) of the accumulation section, and the other end (open end) is rotatably coupled to the lateral transport passage through the coupling portion. This makes it possible to smoothly rotate the accumulation section about an axis thereof.

Preferably, this waste toner container further comprises a rotation guide adapted to rotatably support a portion of the accumulation section on the side of the open end thereof from therebelow, in order to support the rotation of the accumulation section.

Preferably, in the above waste toner container, the accumulation section is formed to have an outer peripheral surface with a bellows-like configuration stretchable/shortenable along an axis of the cylindrical shape.

According to this feature, the accumulation section is formed in the stretchable/shortenable bellows-like configuration. Thus, the accumulation section can be shortened to reduce a space for storing an unused spare waste toner container.

Preferably, this waste toner container further comprises an arm member which is arranged on the side of the open end of the accumulation section, and provided with a pawl configured to stoppably contact at least one of a plurality of large-diameter portions of the bellows-like outer peripheral surface of the accumulation section, . . . the arm member being adapted to be movable between a first posture allowing the pawl to stoppably contact the large-diameter portion, and a second posture allowing the contact state to be released.

According to this feature, the arm member can be set in the first posture to allow the bellows-like accumulation section to be kept in a shortened state.

In the above waste toner container, when the transport screw is formed to have opposite first and second ends and arranged to allow the first end thereof to be located inside the accumulation section, it is preferable that the accumulation section is adapted to be shortened to an extent that the closed end is kept from contacting the first end of the transport screw.

According to this feature, waste toner can be transported to an inward side of the accumulation section by the transport screw.

It is also preferable that the arm member is an arm member having a length of that the closed end is kept from contacting the first end of the transport screw with the arm member engaging the large-diameter portion existing the closed end of the shortened accumulation section.

According to a second aspect of the present invention, there is provided a waste toner-accumulating structure for collecting waste toner removed from an image bearing member provided in an apparatus body of an image forming apparatus. The waste toner-accumulating structure comprises: a waste toner container including a receiving section adapted to introduce the waste toner from an inlet port provided in an upper region thereof and receive therein the waste toner dropped down through the inlet port, and an accumulation section arranged to extend from the receiving section in a lateral direction approximately perpendicular to a dropping direction of the waste toner and rotatably coupled to the receiving section; a holder tray adapted to be movable between a retracted position where the hold tray is retracted in the apparatus body and a drawn-out position where the holder tray is drawn out from the apparatus body, while holding the waste toner container; and a rotation mechanism incorporated in the holder member, and adapted to transmit a rotation from a driving source provided in the apparatus body, to the accumulation section of the waste toner container, under a condition that the holder tray is set in the retracted position.

According to a third aspect of the present invention, there is provided an image forming apparatus which comprises: an apparatus body including a driving source; an image bearing member adapted to bear a toner image on a surface thereof, a cleaning device adapted to remove toner remaining on the surface of the image bearing member; a waste toner container adapted to accumulate waste toner which is the toner removed by the cleaning device, wherein the waste toner container includes a receiving section adapted to introduce the waste toner from an inlet port provided in an upper region thereof and receive therein the waste toner dropped down through the inlet port, an accumulation section arranged to extend from the receiving section in a lateral direction approximately perpendicular to a dropping direction of the waste toner and rotatably coupled to the receiving section, and a rotary member adapted to allow for rotation of the accumulation section; a holder tray adapted to be movable between a retracted position where the hold tray is retracted in the apparatus body and a drawn-out position where the holder tray is drawn out from the apparatus body, while holding the waste toner container; and a rotation mechanism incorporated in the holder member, and adapted to transmit a rotation from the driving source, to the rotary member of the waste toner container, under a condition that the holder tray is set in the retracted position.

The waste toner-accumulating structure or the image forming apparatus of the present invention can have the same advantageous effects as those of the above waste toner container.

This application is based on Japanese Patent Application Serial No. 2008-115542, filed in Japan Patent Office on Apr. 25, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A waste toner container for collecting waste toner removed from an image bearing member, comprising:

a receiving section adapted to introduce waste toner from an inlet port provided in an upper region thereof, and receive therein the waste toner dropped down through the inlet port;

an accumulation section arranged to extend from the receiving section in a lateral direction approximately perpendicular to a dropping direction of the waste toner, and rotatably coupled to the receiving section; and a rotary member adapted to allow for rotation of the accumulation section.

2. The waste toner container as defined in claim 1, which further comprises:

a transport screw provided in the receiving section, and adapted to transport the waste toner dropped from the inlet port and received by the receiving section, toward the accumulation section; and a first coupling fixed to the transport screw, and adapted to receive a torque transmitted from outside the waste toner container.

3. The waste toner container as defined in claim 2, wherein the receiving section includes a heightwise transport passage extending in an upward-downward direction, and a lateral transport passage provided below the heightwise transport passage in a coupled manner to extend the lateral direction, wherein:

the inlet port is provided at an upper end of the heightwise transport passage;

the lateral transport passage has an edge of a first end located on one side coupled with the accumulation section and formed as an open end, and an edge of a second end located on the other side opposite to the first end and formed as a closed end;

the transport screw is disposed inside the lateral transport passage in such a manner as to have a first end protruding from the edge of the first end, and a second end located on an opposite side of the first end to protrude from the edge of the second end; and the first coupling is attached to a distal edge of the second end of the transport screw.

4. The waste toner container as defined in claim 1, wherein the accumulation section is rotatably coupled to the receiving section for rotation about an axis extending in the lateral direction.

5. A waste toner container for collecting waste toner removed from an image bearing member, comprising:

a receiving section adapted to introduce waste toner from an inlet port provided in an upper region thereof, and receive therein the waste toner dropped down through the inlet port;

an accumulation section arranged to extend from the receiving section in a lateral direction approximately perpendicular to a dropping direction of the waste toner, and rotatably coupled to the receiving section; and a rotary member adapted to allow for rotation of the accumulation section, wherein the rotary member includes a second coupling which is integrally provided in the accumulation section, and adapted to receive a torque transmitted from outside the waste toner container.

6. The waste toner container as defined in claim 5, wherein the accumulation section is formed in a generally cylindrical shape which has an open end coupled to the receiving section, and an closed end located on an opposite side of the open end, wherein the second coupling is provided on an outer surface of the closed end.

7. The waste toner container as defined in claim 6, which further comprises a rotation guide adapted to rotatably support a portion of the accumulation section on the side of the open end thereof from therebelow.

8. The waste toner container as defined in claim 6, wherein the accumulation section is formed to have an outer peripheral surface with a bellows-like configuration stretchable/shortenable along an axis of the cylindrical shape.

9. The waste toner container as defined in claim 8, which further comprises an arm member which is arranged on the side of the open end of the accumulation section, and provided with a pawl configured to stoppably contact at least one of a plurality of large-diameter portions of the bellows-like outer peripheral surface of the accumulation section, the arm member being adapted to be movable between a first posture allowing the pawl to stoppably contact the large-diameter portion, and a second posture allowing the contact state to be released.

10. The waste toner container as defined in claim 9, which further includes a transport screw provided in the receiving section, and adapted to transport the waste toner dropped from the inlet port and received by the receiving section, toward the accumulation section, the transport screw being formed to have opposite first and second ends and arranged to allow the first end to be located inside the accumulation section, wherein the arm member is an arm member having a length of that the closed end is kept from contacting the first end of the transport screw with the arm member engaging the large-diameter portion existing the closed end of the shortened accumulation section.

11. The waste toner container as defined in claim 8, which further includes a transport screw provided in the receiving section, and adapted to transport the waste toner dropped from the inlet port and received by the receiving section, toward the accumulation section, the transport screw being formed to have opposite first and second ends and arranged to allow the first end to be located inside the accumulation section, wherein the accumulation section is adapted to be shortened to an extent that the closed end is kept from contacting the first end of the transport screw.

12. The waste toner container as defined in claim 5, wherein the accumulation section is formed in a generally cylindrical shape which has an open end coupled to the receiving section, and an closed end located on an opposite side of the open end, wherein the second coupling is provided on an outer surface of the closed end; and a coupling portion is provided at the open end and rotatably engaged with an outer periphery of the edge of the first end of the lateral transport passage.

13. The waste toner container as defined in claim 5, which further comprises:

a transport screw provided in the receiving section, and adapted to transport the waste toner dropped from the inlet port and received by the receiving section, toward the accumulation section; and a first coupling fixed to the transport screw, and adapted to receive a torque transmitted from outside the waste toner container.

14. The waste toner container as defined in claim 13, wherein the receiving section includes a heightwise transport passage extending in an upward-downward direction, and a lateral transport passage provided below the heightwise transport passage in a coupled manner to extend the lateral direction, wherein:

the inlet port is provided at an upper end of the heightwise transport passage;

the lateral transport passage has an edge of a first end located on one side coupled with the accumulation section and formed as an open end, and an edge of a second end located on the other side opposite to the first end and formed as a closed end;

the transport screw is disposed inside the lateral transport passage in such a manner as to have a first end protruding from the edge of the first end, and a second end located on an opposite side of the first end to protrude from the edge of the second end; and the first coupling is attached to a distal edge of the second end of the transport screw.

15. A waste toner-accumulating structure for collecting waste toner removed from an image bearing member provided in an apparatus body of an image forming apparatus, comprising:

a waste toner container including a receiving section adapted to introduce the waste toner from an inlet port provided in an upper region thereof and receive therein the waste toner dropped down through the inlet port, and an accumulation section arranged to extend from the receiving section in a lateral direction approximately perpendicular to a dropping direction of the waste toner and rotatably coupled to the receiving section;

a holder tray adapted to be movable between a retracted position where the hold tray is retracted in the apparatus body and a drawn-out position where the holder tray is drawn out from the apparatus body, while holding the waste toner container; and a rotation mechanism incorporated in the holder member, and adapted to transmit a rotation from a driving source provided in the apparatus body, to the accumulation section of the waste toner container, under a condition that the holder tray is set in the retracted position.

16. An image forming apparatus comprising:

an apparatus body including a driving source;

an image bearing member adapted to bear a toner image on a surface thereof;

a cleaning device adapted to remove toner remaining on the surface of the image bearing member;

a waste toner container adapted to accumulate waste toner which is the toner removed by the cleaning device, the waste toner container including a receiving section adapted to introduce the waste toner from an inlet port provided in an upper region thereof and receive therein the waste toner dropped down through the inlet port, an accumulation section arranged to extend from the receiving section in a lateral direction approximately perpendicular to a dropping direction of the waste toner and rotatably coupled to the receiving section, and a rotary member adapted to allow for rotation of the accumulation section;

a holder tray adapted to be movable between a retracted position where the hold tray is retracted in the apparatus body and a drawn-out position where the holder tray is drawn out from the apparatus body, while holding the waste toner container; and a rotation mechanism incorporated in the holder member, and adapted to transmit a rotation from the driving source, to the rotary member of the waste toner container, under a condition that the holder tray is set in the retracted position.

* * * * *